US006236363B1

(12) United States Patent
Robbins et al.

(10) Patent No.: US 6,236,363 B1
(45) Date of Patent: May 22, 2001

(54) SMART ANTENNA CHANNEL SIMULATOR AND TEST SYSTEM

(75) Inventors: David F. Robbins, Westford, MA (US); Moeness G. Amin, Berwyn, PA (US)

(73) Assignee: Micronetics Wireless, Hudson, NH (US)

( * ) Notice: Subject to any disclaimer, the term of this patent is extended or adjusted under 35 U.S.C. 154(b) by 0 days.

(21) Appl. No.: 09/375,732

(22) Filed: Aug. 17, 1999

Related U.S. Application Data

(63) Continuation-in-part of application No. 09/016,130, filed on Jan. 30, 1998, now Pat. No. 5,973,638.

(51) Int. Cl.[7] ..... H01Q 3/00

(52) U.S. Cl. ..... 342/360; 342/372; 342/169

(58) Field of Search ..... 342/360, 372, 342/378, 169, 170, 171, 172, 173, 375; 455/423, 424

(56) References Cited

U.S. PATENT DOCUMENTS

| | | | |
|---|---|---|---|
| 5,233,628 | 8/1993 | Rappaport et al. . | |
| 5,425,076 | 6/1995 | Knippelmier . | |
| 5,508,707 | 4/1996 | LeBlanc et al. . | |
| 5,515,378 | 5/1996 | Roy et al. . | |
| 5,570,373 | 10/1996 | Wing . | |
| 5,596,570 | 1/1997 | Soliman . | |
| 5,602,555 | 2/1997 | Searle et al. . | |
| 5,675,581 | 10/1997 | Soliman . | |
| 5,973,638 * | 10/1999 | Robbins et al. | 342/172 |

FOREIGN PATENT DOCUMENTS

| | | |
|---|---|---|
| 0639035A1 | 2/1995 | (EP) . |
| 0647983A2 | 4/1995 | (EP) . |

OTHER PUBLICATIONS

Dan Sweeney, Virtual Wire—Smart Antennas, Cellular Business, Jul. 1996, 4 pgs.

David Nowicki/Jill Roumeliotis, Smart Antenna Strategies, Mobile Communications International, Apr. 1995, 4 pgs.

(List continued on next page.)

*Primary Examiner*—Thomas H. Tarcza
*Assistant Examiner*—Fred H Mull
(74) *Attorney, Agent, or Firm*—Scott J. Asmus; Vernon C. Maine

(57) ABSTRACT

The invention is a method and apparatus for verifying the integrity of a smart antenna system. The simulator section replicates multiple sensors with directional and non-directional components with variables from Doppler, delay and angular spread. Hardware/software combinations simulate the line-of-sight signal, reflected signals, and refracted signals that require manipulation by the smart antenna processor to extract the temporal and spatial information of the signals of interest. The channel simulator of the present invention introduces independent variability of the most significant factors involved in the simulation; delay spread, Doppler spread, and angular spread. The simulated signals have variable numbers, amplitude, phase, delay and bearing components for representing a variety of terrain, environmental, equipment and capacity conditions for both indoor and outdoor applications. The simulation accounts for the various scattering and multipath conditions that are encountered in typical rural and urban environments. The output of the smart antenna processor is checked against input parameters to compare, verify and calibrate the smart antenna system, and the working condition of the individual smart antenna is accurately tested. Co-channel interference nulling, multipath mitigation, and geo-location capabilities are verified by the analysis of the processed data as compared to the input simulation data.

16 Claims, 13 Drawing Sheets

OTHER PUBLICATIONS

Gilder, From Wires to Waves, Forbes ASAP & ArrayComm Supp., Jun. 1995, 12 pgs.

Joe Kennedy et al, Characterization of the Cellular Radio Environment, Microwave Journal, Nov. 1996, 5 pgs.

Fleury et al, Radiowave Propagation in Mobile Communications: An Overview of European Research, IEEE Communications Magazines, Feb. 1996, vol. 34, #2, p. 1–23.

Lal C. Godara, Applications of Antenna Arrays to Mobile Communications, Part I: Performance Improvement, Feasibility, and System Considerations, Proceeding Of The IEEE, vol. 85, #7, Jul. 1997, pp. 1030–1046, 1048–1060.

Chris Ward et al, Third Workshop on Smart Antennas in Wireless Mobile Communications, Dept. of Electrical Engineering, Stanford University, Jul. 1996, 15 pgs.

Vytas Kezys et al, Fourth Workshop on Smart Antennas in Wireless Mobile Communications, Dept. of Electrical Engineering, Stanford University, Jul. 1997, 20 pgs.

Pat Petillo, Testing Multi–Branch Diversity Receivers, Telecom Analysis Systems, Inc., Apr. 16, 1998, 22 pgs.

Pat Petillo, Testing Multi–Branch Diversity Receivers, Evaluation Engineering, Sep. 1996, 3 pgs.

* cited by examiner

SMART ANTENNA CHANNEL SIMULATOR AND TEST SYSTEM

CROSS REFERENCE TO RELATED APPLICATIONS

This application is a continuation in part of U.S. patent application Ser. No. 09/016,130 filed on Jan. 30, 1998, now U.S. Pat. No. 5,973,638 which is incorporated herein by reference for all purposes.

BACKGROUND OF THE INVENTION

1. Technical Field of the Invention

This invention most generally relates to the simulation and testing of smart antenna systems. More particularly, it pertains to methods and apparatus for verifying the functionality and performance of a smart antenna processor by simulating multipath signals and co-channel signals received at a multi-sensor antenna array, including the coordinated effects of delay spread, Doppler spread, and angular spread for all the sensors of the antenna array.

2. Background of the Invention

The personal communication services industry in the wireless market has seen a substantial growth, particularly in the cellular telephone segment. The deregulation of the telecommunications industry has fueled the fire of this rapid expansion, and pushed the technological envelope to new heights. The increased demand requires that innovative systems be developed that allow for more users, greater coverage, improved reception, lower costs, less power, and geo-location ability. And, for those that are using the cellular communications for data transfer and not just voice communication, there is a desperate need for increased speed and tighter bandwidths. Some argue that the existing wire based systems are inadequate to handle the growing need for high-speed telecommunications, and that wireless systems are a viable alternative to expensive fiber optic or cable installations into every home.

In addition, conventional wire connections no longer satisfy the mobile and harried worker who requires instant access anytime and anywhere. The transition from a wire based connective society to a wireless form is also a necessary transition in some applications. Remote areas that have no access to any wiring or do not have access to a high-speed wire network require a dependable and inexpensive way to communicate. The various forms of transportation, including car, train, plane and boat also need to communicate over wireless communication means.

Thus, the need for dependable wireless systems is a necessity in order to sustain the growth of the telecommunications industry, and the high technology sector as a whole. As more and more people experience the convenience and performance capabilities of wireless communications, the consumer demand will further increase.

One of the leading technologies in the wireless market is the smart antenna. The term smart antenna has been used to describe those antenna systems with multiple antenna elements controlled by complex software algorithms that favor the user's signal or the user's location and adapt to the transmission and reception conditions to enhance performance. The geo-location advantages of obtaining data from multiple points and processing this data can be illustrated by a person's bearing ability. As the ear picks up a sound, both ears and the processing of the brain combine to allow the source of the noise to be accurately determined. Listening with a single ear does not give the necessary focus to determine the location.

Smart antenna systems use signal processing methods in conjunction with multiple antennas to achieve significant improvements in capacity and range for wireless mobile communications. Temporal and spatial filtering techniques are devised to effectively mitigate co-channel interference and remove multipaths in all its forms. There are numerous temporal/spatial processing techniques that have been proposed for uplink as well as downlink communications. Each technique is most applicable to a specific multiple access air interface and for deployment under specific operating environment.

The key role of the multiple element antenna arrays at the base station in cellular mobile radio communications is to sample, at different points in space, the waveforms propagating from users who are accessing the same communication channel. The effectiveness of spatial sampling in reducing co-channel interference and mitigating multipath effects depends on an employed signal processing technique that combines the information over time from the different antennas. The aim of any smart antenna system is to recover the user signal of interest (SOI) and produce an output with significantly improved carrier-to-interference ratio. For uplink processing, the offerings and expectations of smart antennas, however, depend on how they exploit the communication channel characteristics and remove its effect on the statistical and deterministic properties of the desired and undesired components of the waveforms incident on the base station.

There are different types of communication formats and systems that are well known in the industry. But all are subject to the same problems and limitations, namely; channel capacity, spectrum efficiency, limited range coverage, co-channel interference, multipath fading, and system complexity. Associated with these problems and limitations are the expensive and time-consuming processes of monitoring and testing the base stations to ensure that they are functioning within prescribed limits for the conditions encountered.

The basic access protocols used for mobile communications, include frequency domain multiple access (FDMA), time domain multiple access (IDMA), and code domain multiple access (CDMA). FDMA uses different frequencies to distinguish the users. In TDMA, different time slots and interleaving allow the users to be distinguished. The CDMA scheme is a spread spectrum method that uses a separate code for each user. The pseudo noise (PN) sequence spreads the spectrum over a larger bandwidth, and reduces the spectral density of the signal. A number of CDMA signals occupy the same bandwidth and appear as random noise to each other.

An additional scheme, space diversity multiple access (SDMA) uses a dynamically changing antenna to distinguish signals, using multipath signals that hit different antenna elements in the array at different times. This delay is used to differentiate the users through spatial distribution and correlation.

Spatial correlation relates to the difference between signals received by separate sensors of a multisensor array. This correlation between the data received by two or more sensors can be measured at the same or at different time instants. Thus, spatial correlation depends on the temporal correlation of received waveforms as well as other variables related to spatial dimension, such as: the narrow and broadband properties of the transmitted signal, the array sensor spacing, the mutual coupling between the adjacent and distant sensors, the height of the antennas and their polarization, the array manifold and the omni-directional features of the array sensors, and the channel dynamics including Doppler, delay, and angular spreads.

Temporal correlation is the correlation between two data samples at the same or different time instant, so it is a correlation across time and only a function of the statistical properties of the transmitted waveforms. Strong correlation makes it easier to differentiate between directional and non-directional components of the data. The non-directional components, .such as thermal noise, are often assumed to be independent from one sensor to another.

Directional components are those generated by near or far transmitters and follow propagation, attenuation, scattering, diffraction, and refraction laws before reaching the receiver. The directional components contain information about the transmitting sources, and this information can be extracted with proper processing in the smart antenna. Thus, the working environment of the antenna contributes significantly to the transmission and reception characteristics. The environment determines the amount of multipath and interferer signals that are introduced in the antenna reception.

Multipath propagation refers to those signals arriving at a receiving antenna as a result of a combination of various components from different directions. Multipath propagation effects depend upon buildings, structures, terrain conditions, and other such objects that can reflect or refract the signal, and cause the received signal power to fluctuate as a function of distance. Large reflectors, and hence long path differences, cause multipath or frequency selective fading. The amount of signal reflected depends on a number of factors, including the polarization of the incident wave, angle of arrival, carrier frequency, and the relative permitivity of the surface.

The speed of radio waves is determined by the speed of light divided by the dielectric constant of the medium, which can be roughly calculated for air by $C=(3\times10^8)/(1)^{1/2}$. The radio waves are subject to reflection, refraction, absorption, and diffraction, that changes the way in which the incident waves may be perceived. Reflection off a conductive surface can be specular or mirror-like, if the reflecting surface is flat. The reflection may also be diffuse if the surface is not flat and the waves are scattered. Refraction occurs when the dielectric constant changes and the angle of incidence upon the refracting medium cause the angle to change because the speed of the wave changes. Absorption refers to the refractive effects of water and gases in the air, and for frequencies of less than 1 GHz, the effects are negligible. Diffraction occurs when the radio waves encounter an object, and curve around the object if the object size is comparable to the wavelength or bend around the object if the object is much larger than the wavelength.

The radio waves are also subject to path losses or attenuation. The attenuation of the direct path occurs relatively slow as the receiver moves through the field, but the addition of obstacles that partially or wholly block the receiver path introduces greater attenuation. The signal received by the antenna is usually a combination of the direct and indirect paths of the transmitted signal, as well as interference signals. The direct and indirect paths taken by the transmitted signal include those directly in the line-of-sight from the mobile to the receiver, and those that involve reflection and refraction off buildings and other objects.

Each signal is strongly influenced by the distance from the transmitter and the angle of incidence at the antenna. Electromagnetic field strength varies in reverse proportion to the square of the distance. But, when atmospheric attenuation effects and the absorption of the terrain are taken into account, the attenuation can be as high as the inverse sixth power of the distance. Fading is the resultant decrease in signal power, and is the product of two variables: Rayleigh distribution and log-normal distribution.

The slow-varying quantity called log-normal distribution occurs over many different wavelengths of the carrier and is called slow fading. Slow fading is actually comprised of two components, a deterministic component and a random component. The deterministic component is a function of distance. The random component changes with the terrain and is termed shadowing.

Typically slow fading attenuation is modeled by a log normal distribution of mean power. A typical urban terrain model shows rapid amplitude variations, on the order of 20 dB, from street to street, illustrating the effects of shadowing. The equivalent suburban model shows average signal strength approximately 10 dB greater and with less rapid variations. And, the rural model shows a further 20 dB improvement. Seasonal variations of the attenuation in rural and suburban models also occur, due to the changing state of foliage on trees and plants. Both the shadowing effect and the deterministic component of path loss are encompassed in slow fading. Across the antenna array, the attenuation will not appreciably change, and is negligible, because the slow fading depends on distance and terrain conditions, and the change from one sensor element to another is miniscule in proportion to the distance traveled by the radio wave.

Rayleigh fading occurs when a receiver operates in an environment where the received signals are made up of series of reflections and refraction from a number of objects, and there is no significant path between the receiver and the transmitter. In this situation, the signals have traveled via different paths and arrive at slightly different amplitudes and phases; hence the signals can combine constructively or destructively. Rayleigh fading or fast fading, gets its name from the Rayleigh statistical distribution used to model its effects. The fast change in signal amplitude caused by the phase differences in signal components is referred to as multipath fading. And, a stationary object may observe fading where the differential phases of various multipath components change rapidly with frequency, which is called frequency-selective fading. If the fading is independent of frequency it is termed flat fading.

Multipath propagation creates the most serious threat to signal degradation in wireless communications. Signals that are reflected off other surfaces may combine with the desired signal but be out of phase. However, multipath signals that are in phase can combine and allow the received signal to be extracted. The ability to reinforce weak signals offers the advantage of extending the range of the transmitting. It offers the alternative advantage of nulling interfering signals to prevent poor signal quality and maintain a low noise floor for the received signals. While it is a potential problem, multipath is also essential for mobile communications. Without multipath processing, there would have to be far more base stations to ensure a direct line-of-sight existed between the base station and the mobile. Multipath effects are more acute in urban areas such as cities, because cities are more likely to have reflecting surfaces producing reflecting paths of varying path length. The three most significant factors for the system designer are delay spreading, Rayleigh fading, and random Doppler shifts.

Rician fading occurs where there are multiple source of reflected signals, but where an additional direct path transmission is present because of a direct line-of-sight (LOS) between the transmitter and the receiver. Examples are satellite links and air-to-ground communications. The Rician statistical distribution is a valid model where the direct and indirect path-length differences are relatively small, leading to small amount of delay spread.

Delay spread occurs when two signals follow separate paths enroute to a receiver in such a way that the distance traveled and the arrival time of the signals will be different. Due to the reflection and refraction nature of propagation signals in the area where a mobile is being used, it receives multiple and delayed copies of the same transmission, resulting in spreading of the signal in time.

Flat fading refers to the cases where latest copy of the signal arrives at the base station after a time duration that is smaller than symbol bit period. When the time difference becomes an appreciable percentage of the symbol bit period, intersymbol interference (ISI) can occur. Symbols arriving out of sequence corrupt preceding or succeeding symbols. For flat fading, which is typical in large cells under FDMA and TDMA schemes, smart antenna systems perform spatial equalization, where a single coefficient for each antenna is adjusted over time to combat co-channel type of interference.

In frequency selective fading, on the other hand, smart antenna systems must perform both temporal and spatial equalization to individually or jointly suppress the ISI as well as the co-channel interference. The higher the data rate or the greater the path length difference, the more likely the delay spread due to multipath.

The delay spread may range from a fraction of a microsecond in urban areas to 100 microseconds in hilly regions that restrict the signal bandwidth between 40 kHz and 250 kHz. This coherence bandwidth is defined as the inverse of the delay spread. In digital modulated schemes, the signal bandwidth is the inverse of the symbol duration. For coherence bandwidth, the different frequency components of the signal arrive at a receiver at different times, and the channel becomes frequency selective. Frequency selective channels are also known as dispersive channels, whereas nondispersive channels are referred to as flat fading channels. A channel becomes frequency selective when the delay spread is larger than the symbol duration and causes intersymbol interference, which may be reduced by using equalizers in TDMA and FDMA systems.

The relative motion between the base station and the mobile user introduces a Doppler frequency shift. The movement in a mobile causes the received frequency to differ from the transmitted frequency due to Doppler shift. Doppler shift is best illustrated by listening to the whistle of a moving train or the born of a moving car. The emitted sound does not vary in frequency or volume, but to a stationary listener, the sound pitch seems different. Because of the Doppler effect, the sound waves are compressed on the front edge and the waves are spread further apart behind the moving object. The frequency is slightly shifted relative to the transmitted frequency. Any movement in a mobile receiver causes it to encounter fluctuations in the received power level. This rate is called the fading rate, and depends on the transmission frequency and the velocity of the mobile unit. For example, a mobile receiver using 900 MHz frequency that is walking would produce a fading rate of 4.5 Hz, whereas the same unit in a speeding vehicle would experience a fading rate of 70 Hz.

As the received signals arrive along many paths, the relative velocity of the mobile with respect to various components of the signal differs, causing the different components to yield different Doppler shifts. This is viewed as spreading the transmitted frequency and is referred to as Doppler spread. The width of the Doppler spread in frequency domain is closely related to the rate of fluctuations in the observed signal. This Doppler shift varies with carrier frequency and mobile velocity, and affects all paths whether direct or indirect. The effect is to introduce another random frequency modulation on the top of any Rayleigh fading, thereby compounding the complicated signal processing.

An additional component, angular spread, refers to the value of the incident multipath and/or interferer signals that are measured relative to the direct line-of-sight signal in both elevation and azimuth axes in a planar array. In contrast, the angle of arrival is measured relative to the fixed axis of the array plane. A particular multipath angle of arrival can therefore be represented by the relative angle spread plus the line-of-sight angle of incidence. The sign of the signals would depend upon their incident angle on the array. Having a known reference in the direct line-of-sight signal, the corresponding multipath components can be determined.

The antennas employed on the base stations can exist in various forms, including omni-directional, directional, phased array, adaptive, and optimal. Directional antennas offer several advantages, including having greater gain in the direction in which the antenna is focused. Multi-sensor arrays such as the phased array, adaptive, and optimal offer some considerable advantages over their single element counterparts.

The multi-sensor arrays handle a larger number of callers by dividing the antenna regions into specific sectors, either fixed or variable. The fixed sector approach simply divides the 360° range into a number of segments, whereas the variable sector approach dynamically changes the sector to correspond to the location of the user. This latter approach avoids handing off a user to another sector as the mobile user travels from the bounds of one sector into another. The bandwidth of the segments can vary, and be changed depending on the number of users and the signal strength and location of the user. If the signal strength is low, a larger bandwidth may be necessary to take advantage of a larger number of received signals.

The received signals can be appropriately summed to produce the information signal. However the increased bandwidth also makes the system subject to greater interference that might corrupt the information signal. The antenna system adjusts to these conditions by narrowing the bandwidth and focusing directly on the user, thus reducing or elimination much of the interference.

The many advantages of the smart antenna system include maximizing capacity, reducing co-channel interference, eliminating/reducing drop-out and hand-offs, smaller channel bandwidth, fewer base stations, and the ability to locate the user. The smart antenna systems employ sophisticated algorithms to extract the data received from multiple sensor elements and process the data according to weighing criteria and various mathematical calculations.

The directional control of the smart antenna allows the antenna to adjust the angle of incidence of the received signals. This allows the antenna to change the phase of the in-coming signals. The smart antenna takes advantage of the phase characteristics of the RF transmissions to enhance performance. It is well known that signals that combine with the same phase produce a signal with resultant amplitude of the combined signals. Similarly, signals that combine with opposite phase are nulled. By taking advantage of the directional capability of the antenna, the smart antenna amplifies the information signals and nulls the interference.

A smart antenna significantly reduces the handoff problem because the processing allows for a greater coverage of the base station range. In addition, lower signal levels can be transferred, because the smart antenna can use the directional capability to null interfering signals and reinforce several low-level signals. Also, by tracking the location of the user, the calls can be transferred not only by a low signal level, but also as the user may be entering into an obstruction that can be handled by another base station.

The economic benefit achieved by the smart antenna is dramatic. The extended coverage of the individual base stations translates into a lesser number of required stations. And, the efficient processing of the smart antennas allow for additional capacity to be handled by the smart antenna system. The processing also can force handoffs when the two or more users are creating significant co-channel interference due to their relative proximity.

The signals that are received on the different elements of the antenna array are combined to form a single output. The array response as a function of an angle is normally referred to as the array pattern or beam pattern. The process of combining the signals from different antenna elements is called beam forming, and requires weighting the individual components prior to summation. The direction in which the array has maximum response is said to be the beam pointing direction. Thus, this is the direction in which the array has maximum gain. The array pattern drops to a low value on either side of the beam pointing direction, and this point is called a null. Theoretically, the null is the position where the array response is zero, but in practice, the null position represents some value slightly larger than zero. The pattern on either side of the beam pointing direction that is between the null locations is called the main lobe.

For a given array, the beam may be pointed in different directions by mechanically moving the array, known as mechanical steering. The beam can also be steered by delaying the signals before combining them, either by phase shifting or adding a delay. Thus, even thought the main beam is pointed in a different direction, phase adjustments can place the main lobe in the same relative position to the side lobes without physically moving the antenna. Changing the gain and phase of each signal can shape the pattern as required. The phase and gain applied to the signals to shape the pattern can be extrapolated as a single complex quantity, arrived at by applying appropriate weighting to the individual signals. The ability to alter the array pattern is used to cancel interfering signals at the same frequency by positioning the null location appropriately.

Smart antenna systems manufactured for wireless communications range from switched beam to fully-adaptive, uplink only to uplink and down link, with the benefits provided by the various approaches differing accordingly. Most smart antenna systems are deployed at the base station for uplink signal processing. By equipping the base with smart antenna arrays, it is possible to fully exploit the spatial dimension in a wireless communication system. Multiple antennas provide a processing gain to increase the base station range and improve coverage. The capabilities of the antenna array to discriminate between signals based on their angles of arrival lead to reduced interference levels, which in turn can be traded for increased capacity of the system. A wide range of wireless communication systems may benefit from spatial processing including high mobility cellular systems, low mobility short range systems, and wireless local loop applications. To further increase the system capacity, spatially selective reception as well as spatially selective transmission may be adopted.

Each antenna array output represents a weighted sum of the desired signal, the undesired signals, and noise. The data-independent version of smart antennas is the switched beam antenna, which creates fixed sectors of cell sites. These sectors are divided and possibly sub-divided into a greater number of sub-sectors. Each sub-sector contains a predetermined fixed beam pattern. The center of the fixed beam possesses the greatest sensitivity, and the sensitivity decreases at the edges of the sub-sector. A mobile user is designated into a certain sector depending on the strongest signal received by the sub-sectors. The system monitors the call and switches between sub-sectors as required. The switched beam system has some limitations because the signal strength decreases as the user moves to the edges of the sub-sector. The switched beam is also not effective in nulling interfering signals that are closer to the center of the sub-sector.

The simplest form of data-dependent smart antennas is obtained by applying an appropriate complex weight to each sensor and then summing the outputs. The sensor weights are described by the equalizer weight vector. If the weight vector is adapted in real time in an optimum manner, it is possible to cancel the undesired interference and enhance the desired signal above the noise level, and as such, achieve performance which is far superior to both the single antenna case and multiple-antenna fixed beam systems.

The signals reaching the base station are collected over time at the different antenna elements of the array and are weighted and combined to mitigate the effects of multipath fading of the desired signal and reduce the co-channel interfering signals. The temporal/spatial combiner process involves second or higher order statistical moments and intensive correlation functions. It is based on the minimization of a cost function, which is different for different smart antenna systems.

The minimization is achieved either adaptively or by block processing, and aims to suppress interference and combat signal fading so as to ultimately increase the signal to interference noise ratio. The array weights are adjusted every data sample or every data block using blind or nonblind techniques, which is based on the availability of a training sequence or directional information. Adaptive techniques are devised to exploit any a priori information of the temporal structure of the desired signal or the location of its source. They rapidly track the desired and interfering signals in order to dynamically adjust the main lobe and nulling lobes of the smart antenna array pattern.

There are numerous techniques that could be employed to process the data received by the multiple antennas. "Smarter" antennas yield more performance improvement over the single receiver case. The most powerful smart antenna techniques are those that are devised for specific multiple access schemes such as FDMA, TDMA, or CDMA. These techniques are often structured to utilize both the temporal and the spatial characteristics of the signals over time and space. They all aim to provide some sort of temporal/spatial equalization to mitigate the effects of multipath and co-channel interference.

In principle, spatial equalization is primarily concerned with the removal of the co-channel interferers based on their angles-of-arrival, which are different from that of the signal of interest, as well as their uncorrelation with the SOI. The temporal equalization, on the other hand, primarily targets the multipath and mitigates its effect by utilizing the coherence properties of the delayed versions of the signal. The spatial and temporal equalization can be performed independently or may be combined under one optimization criterion, which can be formulated consistent with a specific multiple access scheme.

The multiple elements of the antenna and the subsequent processing allow the location of the transmitted signal to be determined in a highly calibrated and refined system.

This geo-location capability of the smart antenna is a requirement under recent telecommunications law. According to this recent legislation, service providers are under an obligation to implement a geo-location platform, whereby the location of users can be ascertained. The reasoning behind the legislation is to allow emergency callers of 911 to be located quickly with that information made available to the proper authorities. Because of the advantages of a highly calibrated smart antenna, the geo-location of all sources of transmission will be calculated. The presence of a line-of-sight between the mobile unit and the base station is important for smart antennas aiming for geo-location of the wireless communication channel users. The smart antenna systems therefore need a mechanism to calibrate the system as a whole and ensure that it functions within certain specifications.

The advantages of smart antenna systems are described in U.S. Pat. No. 5,515,378. This patent describes the advantages of utilizing the spatial data from various antenna elements to increase the capacity, coverage, and quality of wireless communication networks as well as other benefits that derive from geo-location capability. Further information on geo-location is found in U.S. Pat. No. 5,508,707, which describes a polygonic method for obtaining directional data. This patent explains the needs and the benefits of tracking the location of the mobile unit.

U.S. Pat. No. 5,233,628 is for a computer based bit error simulation method and apparatus used in digital wireless communications. The disclosed simulation allows quantitative testing of digital baseband systems prior to product completion, or as a substitute for field testing. The system utilizes complex algorithms to generate the required test signals. The transmitter section copies and generates the data stream of the unit to be tested, the data stream is manipulated by the bit-error-rate (BER) simulator section, and the receiver section analyzes the bit error rates under simulated conditions.

The invention described in European patent applications 94120494, 94305383, and U.S. Pat. No. 5,602,555, describe a base station arrangement. The three applications are all related and the entire method and apparatus of a smart antenna are disclosed, along with the benefits of such a system.

U.S. Pat. Nos. 5,675,581 and 5,596,570 are related patents and describe a method and apparatus for simulating interference. The systems use a white noise generator and signal processing techniques to generate variable interference components.

None of the prior art reveals or discloses any of the functionality or operating characteristics of the present invention, but instead provides a good background for the present invention and illustrates the need for the present invention.

Thus, multi-sensor antenna arrays, such as the smart antenna system, are a viable alternative for the expansive mobile communications systems. The many advantages of the smart antenna system include maximizing capacity, reducing co-channel interference, eliminating/reducing drop-out and hand-offs, smaller channel bandwidth, fewer base stations, and the ability to locate the user. The smart antenna systems employ sophisticated algorithms to extract the data received from multiple sensor elements and process the data according to minimization criteria and various mathematical calculations.

In conjunction with this highly sophisticated processing, there is a need for comparably sophisticated testing. The present method of testing multi-sensor antenna arrays involves the simulation of a single channel. These present techniques sometimes simulate delay spread or Doppler spread, alone or in combination, but do not combine the effects of delay, Doppler, and angular spread in a multi-channel environment. The prior art testing methods tested various parameters for a single channel and the functionality of the antenna array was judged by these results. This single transmission testing is inadequate to properly test the smart antenna system, and does not account for the practical situations and environmental conditions.

Current testing methods and systems fail to integrate and simulate the effects of delay spread, Doppler spread, and angular spread on the smart antenna processor system. Present calibration/test methods and systems fail to reveal the minimum and maximum threshold levels of the processing capabilities of a smart antenna system installation.

The current methods fail to adequately simulate the conditions of urban and rural environments as well as other interference parameters. Current test systems don't produce the highly calibrated smart antenna systems required for more efficient operations, increased capacity, and overall improved operation.

Current test systems are unable to replicate the dramatically different effects of scattering and multipath fading at different antenna sites. The current testing equipment and methods only test a single antenna element at a time and completely disregards the actual conditions of the antenna in use. What is needed is a methodology and a device for generating multiple source signals that allows for operator control and adjustment of simulated environmental and equipment conditions.

SUMMARY OF THE INVENTION

The essence of the present invention is a method and an apparatus to verify the integrity of a smart antenna system by simulating actual wireless reception conditions of multiple sensor arrays and verifying the processed data output. In the preferred embodiment of the invention, this is the hardware/software simulations of the line-of-sight signal, reflected signals, and refracted signals that require manipulation by the smart antenna processing to extract the temporal and spatial information of the signals of interest.

The channel simulator of the present invention introduces independent variability of the most significant factors involved in the reception, namely, the delay spread, the Doppler spread, and the angular spread. The simulated signals have variable numbers, amplitude, phase, delay, and bearing components to test the smart antenna processing under a variety of terrain, environmental, and capacity conditions. The simulation accounts for the various scattering and multipath conditions that are encountered in typical rural and urban environments. The working condition of the individual smart antenna is accurately tested and the co-channel interference nulling, multipath mitigation, and geo-location capabilities verified by the analysis of the processed data as compared to the input simulation data.

The test equipment simulates the expected operating environment that will be experienced by the base station. The testing system is set to provide the time, frequency, and angle dispersion of the communication channel most favorable to the underlying mechanism driving the multi-antenna system. The antenna system is also tested in the conditions least probable to that system to verify the integrity and enable robust performance that would allow acceptable performance even if the normal conditions change. As an example, an indoor rural system that is initially tested only for line-of-sight environments may fail if subsequent obstructions are placed in the direct line-of-sight, because these conditions were not normally tested. The smart antenna tester simulates these other conditions and expands the working environment to other conditions, or at least provides an accurate range that the system can handle.

The data received at the different sensors of a multiple sensor antenna are not necessarily independent, random, or coherent. The relationship of the sensor data across the array is one of the most significant advantages of smart antenna systems. The relationship carries information about the angular position of the signal of interest (SOI) and co-channel interferers, the spatial spread of each source, as well as the corresponding propagation channel. It is this wealth of information obtainable from the multiple elements of the array that makes the smart antenna system desirable and effective. The multipath signal and fading generators currently used for testing purposes only characterize the delay spread, and possibly the Doppler spread, and are incapable of testing the angular spread.

The testing of the smart antenna system thus ideally includes simulations of the operating environment, the signals direct paths and multipaths, the number of users, and co-channel interference in the frequency band/time slot of interest, the delay spread, the Doppler spread, and the local and remote scattering effects. Among the performance measures and evaluation criteria of such a test system, there is the ability to increase the signal-to-interference and noise ratio (SINR), reduce the bit error rates (BER), and/or determine the location of all sources whose waveforms are received by the base station.

The present invention comprehensively simulates the communication channel by incorporating its three main spreading effects, namely, delay spread, Doppler spread, and angular spread. The delay spread gives rise to frequency-selective fading, whereas the Doppler spread causes time-selective fading. The angular spread is responsible for the spatial-selective fading and it varies depending on whether the transmitted signal is reflected from objects local to the mobile, the base station, or remote objects. This type of spreading along with the directions of arrival of all scattered and unscattered signals are transparent to a single antenna base station, however they are vital parameters that significantly influence smart antenna systems.

The single channel test cannot extract this information. The multiple sensor correlation of signals received across the array are used to perform the following: Steer nulls in the direction of co-channel interferers, steer nulls in the direction of multipaths, steer a beam toward the direct path, steer a beam towards a user multipath, increase the signal-to-interference and noise ratio (SINR) at the array output. The temporal/spatial correlation functions are jointly used to reduce intersymbol interference, remove co-channel interference, and mitigate adjacent channel interference, all of which lead to improved capacity, range, and frequency re-use.

The testing of the smart antenna incorporates the characteristics of each antenna element of the array. This includes the changes in the amplitude and phase response as a function of frequency and incident angle of arrival. Because it is impossible or very difficult to have a perfectly uniform array and to make every antenna element identical, some variations exist that could affect the processing of the received signals. The smart antenna test system induces response and displacement errors to test the robustness of the smart antenna system to array imperfections.

Since the primary objective of the smart antenna system is to spatially filter the co-channel interference and the multipath components of the signal of interest, the present invention simulates a communication channel where each signal arrival at the base station is tagged with its angle of arrival and its angular spread or scattering bandwidth. The direct line-of-sight signals, as well as all multipaths, co-channel interferers, and adjacent channel interferers incorporate directional information as part of the transmission.

The present invention can also simulate the operating environment that is most applicable to the mechanism behind co-channel interference nulling and source localization capabilities of that specific system. The number of co-channel interferers along with propagation channel dispersive effects over the angle, time, and frequency variables are tuned to emulate a specific wireless communication channel which may be favorable or unfavorable to the underlying system. Each smart antenna technique is based on a set of assumptions about the propagation channel. When these assumption are satisfied, high performance is achieved and improvement in Bit Error Rates (BER), Carrier-to-Interference ratio (C/I), Drop Off Rates (DOR), Outage Probability (OP), or in any other evaluation criterion and measure of performance, becomes evident. Equally important, however, the present invention provides for testing the same system with an operating environment that violates one or more of the assumptions made by that particular smart antenna system to make a more robust system.

Any propagation environments are easily simulated by properly choosing the data at the different antenna array elements. For example, in rural environment with few significant scatterers and high likelihood of line-of-sight propagation, smart antenna systems processing is likely to be based on angle of arrival estimation (geo-location) of the users. In this case, to test whether the underlying smart antenna system will function poorly or properly for obstructed line-of-sight, one can easily choose the data entering the different sensors to emphasize simulation of multipath propagation.

There are several parameters that affect the performance of smart antennas systems. Some of these parameters are attributed to the wireless radio communication channel while others are introduced by the antenna array geometry and structure. The greater the distance in between adjacent antennas, the smaller the spatial correlation function across the array. In this case, spatial selectivity and estimation of the signal bearing becomes more difficult.

Most smart antenna systems can easily handle one or few co-channel interferers. The number of interferers that can be spatially located and effectively nulled is equal to, at most, one less than the number of antennas mounted at the base station. Therefore, an environment with a large number of co-channel interferers will prove difficult to process by any smart antenna system and result in a small number of degrees of freedom.

The larger the scattering bandwidth the weaker the spatial correlation between the data across the array, and in turn, the lesser the effectiveness in exploiting the information gathered from the different antennas. Also, a large scattering bandwidth will cause problems in resolving the signals originated from two close mobiles, where the scattering radii overlap.

Imprecise information about the antenna spatial coordinates and the gain and phase sensitivity of each antenna array element as a function of frequency and bearing may present a difficult problem in filly or partially utilizing the data received by the multi-antenna array. Antenna element displacements and ambiguity in the array manifold will significantly hinder the performance of those smart antenna systems that base their performance on the ability to obtain unbiased low-variance estimates of the angles of arrival of the transmitted signals. A well- calibrated array is important to eliminate such problems.

Large Doppler spreads imply fast time-varying channels, i.e., small coherence times. Therefore smart antennas that perform any sort of time-averaging of the data must do so over short time-intervals to account for the non-stationary effects of the channel. Smart antennas systems that employ adaptive spatial or temporal filtering techniques must tune the filter coefficients with a speed consistent with the rate of channel variations. The Doppler shift component can be simulated, together with Rayleigh fading, by applying sine and cosine waves at the Doppler frequency to the in-phase and quadrature-phase inputs, respectively, in addition to the Gaussian noise.

One of the most important elements in testing the smart antenna system is the propagation delay. As each signal arrives at the antenna array, it arrives at each element at a slightly different time relative to the angle of arrival. The arrival angle is a function of elevation in a linear array, and both elevation and azimuth in a planar array. For linear uniform arrays, the propagation delay between two adjacent sensors is expressed as:

$$T=d \sin \theta/c$$

where d equals the spacing between the antenna elements, c is the speed of light, and θ represents the angle of arrival. In a planar array system, the propagation delay to the i-th sensor can be expressed as:

$$Ti=1/c\ (\Delta xi \sin\theta \sin\Psi+\Delta yi \sin\theta \cos\Psi)$$

where Δxi and Δyi represent the displacement along the x axis and the y axis from the reference sensor or the array center, respectively, θ designates the elevation angle, and Ψ refers to the azimuth angle.

The propagation delay simulator of the present invention is similar to existing multipath delay generators in that they contain the same basic elements. But, the propagation delay simulator generates many times the number of multipath delays. As an example, an antenna array of eight sensors requires eight propagation delays for each multipath delay. In the antenna array, all eight sensors would receive the incident signal, thus the propagation delay simulator must generate delayed versions of the same signal, with the latest version corresponding to the time taken to travel across the entire array.

The propagation delay signals delivered to the smart antenna processor are the result of the antenna array geometry and the desired incident angle of arrival. Therefore, the test system uses the propagation delay to model the various incident arrival angles for particular array geometry. The interstitial spacing between the sensor elements and the incidence angle of arrival of the signal upon the antenna array are components of the propagation delay. Equally spaced sensors simplify the processing of the propagation delay in terms of computational and memory requirements because the propagation delay from the first sensor or the reference sensor to the N-th sensor is (N−1) times the propagation delay between two adjacent sensors. The smart antenna test equipment generates individual signals for the array sensors, wherein the individual signals have a different propagation delay adjusted according to the various arrival angles, and corresponding to certain antenna array geometry.

With the capability of varying each incident angle of arrival, a given propagation delay signal is generated. But, multiple possible origin points and multiple possible propagation delays are possible for each signal due to reflection and refraction. In operation, the correct source of origin is determined by using the multipath and co-channel signals and processing the results in the smart antenna processor. Thus, the test equipment also generates the equivalent multipath and co-channel signals that would correspond to the given environment. The multipath signals represent multipath delay and reflection parameters that produce a separate signal incident upon the antenna array with corresponding propagation delay parameters due to the array geometry and angle of incidence. The test equipment generates the equivalent signals corresponding to each of the sensor elements.

The angular spread is a value that is measured relative to the direct line-of-sight signal in both elevation and azimuth axes in a planar array, whereas the angle of arrival is measured relative to a fixed axis, often is chosen perpendicular to the array plane. A particular multipath angle of arrival can therefore be represented by the relative angle spread plus the line-of-sight angle of incidence. The sign of the signals depends upon their incident angle on the array. Having a known reference in the direct line-of-sight signal, the corresponding multipath components can be determined. And, the test equipment generates any number of multipaths that would be used to represent the contribution of the radio communication channel.

The effects of scattering are modeled depending upon the conditions desired, and the angular spread is varied to encompass these conditions. Similarly, changing the angular spread simulates the effects of reflection. Signals traveling the same path length may lead to two different angular spreads due to local scattering. Scattering in the vicinity of the mobile causes small angular spread, whereas multipaths caused by scattering near the base station generate very large angular spreads. And, multipaths from remote reflections cause moderate to large angular spreads. Varying the angular spread thus characterizes the particular conditions desired when testing the smart antenna system.

The multipath signals generated by the test equipment are tagged according to the angle of incidence or the angular spread. Each multipath signal for each sensor element simulated by the test equipment contains the same propagation delay parameters based upon the array geometry and angle of incidence upon the array. The effects of nulling and reinforcing of the incident signals are verified to allow for the improved performance of the smart antenna system. The overall testing of the cellular environment accounts for co-channel interference, multipaths, path loss, noise, Doppler spread, and fading. The various parameters of the model are adjusted to simulate differing conditions and environmental conditions to provide comprehensive testing of the smart antenna system.

The energy signal received by a sensor element of the antenna array is represented as the sum of the transmitted signal combined with all multipaths, co-channel interferers, and multipaths of the interferers. For a given time, and a single element, the signal can be represented by:

(transmitted signal)(all multipath signals)(path fading envelope)+(transmitted signal)(all co-channel interferers)(all multipaths of the co-channel interferers)( path fading envelope)+additive thermal noise.

The transmitted signal represents the information signal that is essentially the user signal, and establishes a reference signal for all additional received signals. The user signal is identified by some specific frequency band/time burst/code or otherwise tagged and identified by the processing system as the user signal. If the transmitted or reference signal is lost, the processing of any multipaths or interferers are uncorrelated, and the system will merely transmit whatever it receives.

The path fading is represented as an envelope, indicative of the attenuation of the signal with respect to time and distance. Each signal has a different path fading envelope, a different slow fading envelope, and a different fast fading envelope. The multipath fading envelopes are most significant, because these signals presumably travel a longer distance and time. While the slow fading envelope is constant across the array, the fast fading envelope may change from one antenna to another, specifically for those base stations which implement spatial diversity techniques.

There are any number of multipaths and co-channel interferers, depending upon the terrain and the environment. There can also be multipaths to the co-channel interferers. The slow fading (log-normal distribution) and the fast fading (Rayleigh or Rician representation) are also elements of the received signal at each sensor. The path loss is a direct function of the distance traveled through air, including the losses through slightly different dielectric mediums. For higher frequencies the path loss would change depending on the weather, as moisture (rain, snow, hail) alters the dielectric constant. But, for frequencies under I GHz, the weather conditions are a negligible concern.

There is also a small component of loss attributed to the additional distance traveled between the sensor arrays. The thermal noise component is also a factor in electric circuits, and the level of the noise can be an appreciable limiting factor in the overall reception ability of the antenna. The signal arrivals may add or subtract from the total depending upon the angle of arrival, the scattering in the communication channel, the propagation delay, and the array geometry. The present invention models these conditions.

There are several other components of the combined sensor equation of the present invention that are inconsequential to the total, and are excluded from the overall computation. The path loss across the antenna array from sensor to sensor is a negligible quantity and will not be part of the overall equation. The slow fading or shadowing, although a random component, assumes a fixed value across an array of reasonable size aperture. While these factors are considered negligible, it is within the scope of the invention to incorporate these values into the overall computation.

The equation to model the parameters of the received antenna signals of the planar array is as follows:

$$x_i(t) = \sum_{p=1}^{L} a_i(\theta_p)\gamma_{ip}(t)u(t-\tau_{ip}) + \sum_{q=1}^{Q-1}\sum_{p=1}^{Lq} a_i(\theta_{pq})\gamma_{ipq}(t)u(t-\tau_{ipq}) + n_i(t)$$

Where the variables are defined as follows:

$x_i(t)$: is the signal received at the i-th sensor of the antenna array and 't' is the time variable. This signal is the sum of the user signal and its multipath, the co-channel interferers and their multipaths, and the additive thermal noise component.

M: the number of sensor elements of the antenna array.

L: the number of multipaths for the user signal.

Q: the number of co-channel interferers.

$L_q$: the number of multipaths for the q-th interferer.

u(t): user transmitted signal that depends on the modulation waveform and the information data stream.

$u_q(t)$: is the q-th interferer signal that depends on the modulation waveform and the information data stream.

$\tau_{ip}$: is the p-th multipath delay of the user signal; received by the i-th sensor of the array.

$\tau_{ipq}$: is the p-th multipath delay of the q-th interferer received by the i-th sensor of the array.

$\gamma_{ip}(t)$: is the complex envelope of the path fading for the p-th multipath of the user signal at the i-th array sensor.

$\gamma_{ipq}(t)$: is the complex envelope of the path fading for the p-th multipath of the q-th interferer at the i-th array sensor.

$a_i(\theta_p)$: is the amplitude-phase response of the i-th sensor to the p-th multipath of the user signal arriving at the angle $\theta_p$.

$a_i(\theta_{pq})$: is the amplitude-phase response of the i-th sensor to the p-th multipath of the q-th interferer arriving at the angle$\theta_{pq}$.

$n_i(t)$: is the additive thermal noise at the i-th array sensor.

In order for the simulator to generate the proper signals, certain information is required. The interstitial spacing between each antenna element is necessary to determine the proper delay and spread. The azimuth and elevation coordinates of the sensors relative to a reference set of coordinates are needed to precisely define the sensor response. At each sensor element, the gain vs. frequency and angle of arrival must be properly modeled to enable the simulator to generate the correct response. In addition to the antenna geometry and gain characteristics, the antenna height must also be provided.

According to the present invention, the introduction of programmable multipath delay spread, Doppler spread, and angular spread for each antenna element provides a unique testing method. Controlling all three parameters allows the operator to essentially mimic any condition that a smart antenna system may encounter. The precise limitations and offerings of the smart antenna system are accurately defined for a given situation and environment. The output of the smart antenna processor may be monitored by a bit-error-rate tester for compliance with the input data.

The angular spread that is introduced can be dependent or independent of the other parameters. The operator of the smart antenna test equipment sets the angular spread of each signal in its three different forms, due to local scattering next to the mobile, next to the base station, and due to remote objects. The ability to correlate the angular spread with the other parameters allows simulations of the joint variable profiles in wireless communication channel such as the angle-delay profile based on the concept of ray-tracing.

One of the features of the test system and simulator is the ability to select the channel fading rate and duration for testing the smart antenna response to time-varying conditions. Specifically, the convergence properties and tracking capabilities of the adaptive algorithms under both the fast and slow fading environmental conditions. The present invention adjusts the angular positions of the sources to establish high-resolution angle of arrival estimation challenging scenarios to smart antenna systems so as to test their capabilities to resolve two closely spaced sources.

The present invention also accounts for the local scattering patterns of the smart antenna by introducing adjustable levels of local scattering effects. The number of multipaths for each user and the co-channel interference is adjustable and variable to adequately test the processing. And, the test system simulates multipath, flat and frequency selective fading, Rayleigh and Rician fading, delay, angular, and Doppler spreads.

As a test system, the present invention transmits a reference signal to the simulator. The reference signal can be a simple digital stream of data or an analog signal. The analog signal would require and analog-to-digital conversion and possibly a downconversion to bring it into the proper frequency band. The signal is then sent to the simulator, where the delay, Doppler, and angular spread are introduced. The signals are split and properly conditioned according to input parameters. The conditioned signal is sent to the smart antenna system, where the smart antenna processes the signal as is well known in the field. The output of the smart antenna is a digital stream of data that represents the reference signal along with additional derived data including geo-location information. The test system also simulates classic and flat Doppler Spectra for outdoor and indoor fading environments, respectively. The geo-location information is extracted from the input test signals and represents the physical location of a supposed mobile unit. The location information is input along with the other input parameters and conditioned by the multi-channel simulator. The smart antenna output is measured by a measuring device, and compared with the expected signal. The comparison of the data can be performed by a separate computer interface or by a measuring device if linked to the reference signal information. An example of a linked measuring device/signal source is a bit-error-rate tester (BERT). A BERT transmits and receives digital streams of data and the source and receive segments are interconnected.

An additional object of the invention is a smart antenna simulator for simulating output sensor signals for a smart antenna processor, comprising a reference signal, a means for translating assumed environmental and equipment conditions of a smart antenna array into signal conditioning parameters representing delay spread effects, Doppler spread effects, and angular spread effects, a means for tapping the reference signal with the delay spread effects to create a set of multipath signals as a function of the assumed environmental and equipment conditions, a means for splitting each multipath signal into at least one set of channel signals, each channel signal of the set corresponding to a respective sensor of the smart antenna array; a means for modifying the channel signals with Doppler spread effects and angular spread effects as a function of the assumed environmental and equipment conditions; and a means for summing respective modified channel signals across the sets into at least one sensor signal as a function of the assumed environmental and equipment conditions. And yet another object is a smart antenna simulator of wherein at least one sensor signal comprises multiple sensor signals, one each for each of the sensors of the smart antenna array.

A further object is a smart antenna simulator comprises a means for correlating the channel signals, wherein the means for correlating is derived from one or more spatial channel models. Examples of spatial channel models include Lee's Model, Discrete Uniform Distribution, Geometrically Based Circular Models, Gaussian Wide Sense Stationary Uncorrelated Scattering Model, Gaussian Angle-of-Arrival Time-Varying Vector Channel Model Uniformed Sectored Distribution, Modified Saleh Valenzuela's Model, Spatio-Temporal Model, and Ray Tracing Model. The spatial fading models are used to determine the correlation at each sensor signal.

Another object is the smart antenna simulator wherein the signal conditioning parameters further comprise representing Doppler Spectrum, and there is a means for modifying the multipath signals with the Doppler Spectrum. There should be an independent means for adjusting a correlation function of the desired signal, its multipaths, and the interferers across the array according to specified spatial channel models.

Still other objects and advantages of the present invention will become readily apparent to those skilled in this art from the detailed description, wherein we have shown and described only a preferred embodiment of the invention, simply by way of illustration of the best mode contemplated by us on carrying out our invention. As will be realized, the invention is capable of other and different embodiments, and its several details are capable of modifications in various obvious respects, all without departing from the invention.

DESCRIPTION OF THE PREFERRED EMBODIMENT

To those skilled in the art, the invention admits of many variations. The following is a description of a preferred embodiment offered as illustrative of the invention but not restrictive of the scope of the invention.

Comprehensive testing of smart antenna processors requires the generation of signals parameterized by the delay spread, the Doppler spread, and the angular spread. The functionality of the smart antenna is partly based on its ability to utilize the differences in fading statistics at the different antennas to extract information based on the spatial spread and angle of arrival of the incident signals. Thus, the test signal incorporates multipaths, co-channel interferers, adjacent channel interferers, directional and non-directional information. The directional information pertains to the angle of arrival and the spatial spread.

Figure 1:
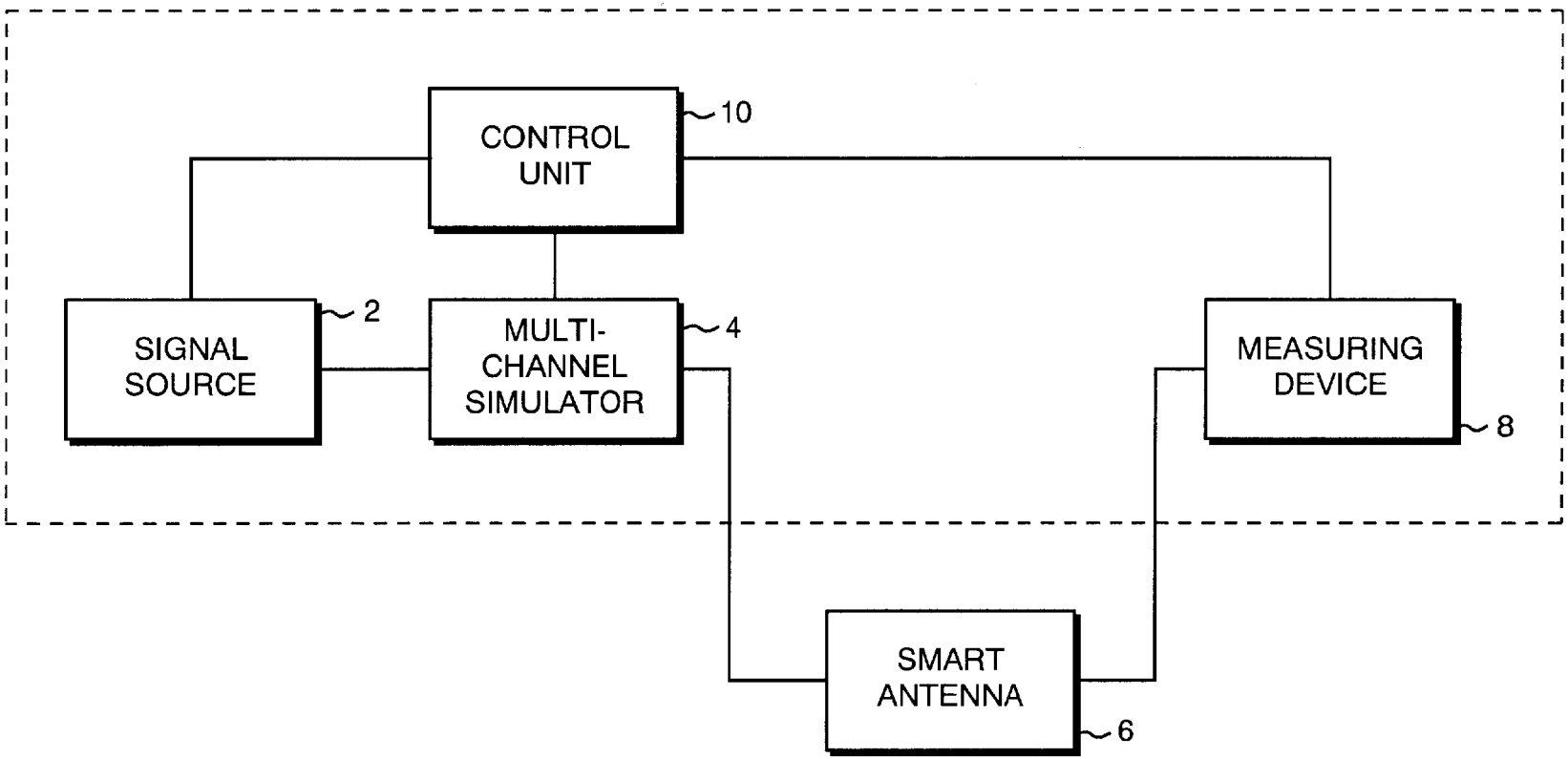
FIG. 1 is a block diagram illustrating the basic components of a smart antenna test system connected to a smart antenna.

FIG. 1 is a basic block diagrammatic view of the smart antenna tester system. The signal source 2 generates the necessary input to initiate the testing sequence. The signal source can be an antenna transmitter unit, a single signal source, or multiple signal sources. The source can provide a digital or analog reference signal, and the hardware/software of the simulator will perform the necessary processing to convert the reference signal into a digital signal at the proper baseband. If the signal source transmits a single signal the multi-channel simulator 4 splits the signal into the necessary number of signals representing the number of desired multipaths, co-channel interferers, and the co-channel interferer multipaths desired for any number of sensor elements. If the signal source transmits a plurality of parallel signals corresponding to the number multipaths, the initial splitter portion of the multi-channel simulator can be by-passed. The multi-channel simulator processes the input signals using complex algorithms to replicate the desired test conditions. The Doppler, delay, and angular spread are calculated along with other parameters to simulate the practical environment of the antenna. In addition, the local scattering effect is also simulated. The control unit 10 has an operator interface that permits the user to set the desired environmental conditions for testing and to vary the conditions to anticipate change.

After the signals are conditioned by the simulator 4, these test signals are transmitted to the smart antenna receiver assembly 6. The test signals are the analog signals representing the reception characteristics of a multiple element array antenna. The smart antenna receives the simulated signals and proceeds to process the signals in the same fashion in which it would process any communication reception. The output of the smart antenna is a digital stream of data that represents the information signal along with other injected and derived components. A measuring device 8 is connected to the smart antenna output to read the digital data. There are existing measurement devices that can interpret the digital data and calculate the smart antenna output signals including the geo-location of the simulated user. The reference source signals, as modified by the simulator, are then compared to the smart antenna output data. The measurement device, or the control unit, or a combination of the two units then compares the data to verify the performance.

Figure 2:
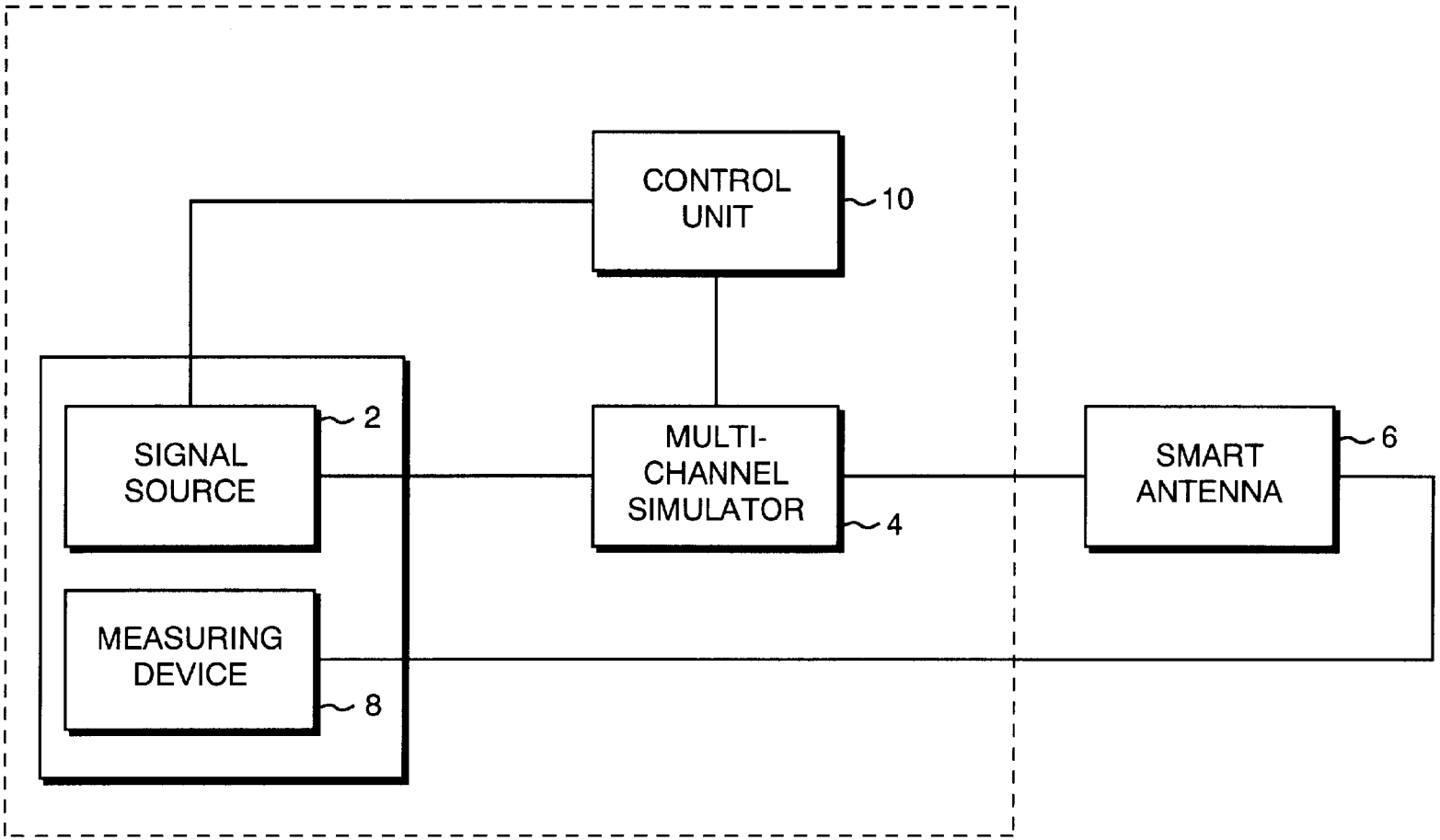
FIG. 2 is a block diagram illustrating the basic components a smart antenna test system connected to a smart antenna where the signal source and measuring device are linked.

Another embodiment of the smart antenna test system is shown in FIG. 2, where the channel simulator 4 and control unit 10 are used in conjunction with a linked signal source 2 and measuring device 8. By using a linked signal source 2 and measuring device 8, the reference signal and the smart antenna output signal are directed coordinated. The addition of the control unit inputs provides the total information necessary to evaluate the output of the smart antenna processor. There are commercially available devices such as a bit-error-rate tester (BERT) available as a single unit that act as a signal source and measuring device. The BERT transmits digital streams of data and processes received digital data. This system otherwise performs as the tester of FIG. 1.

The signal source 2 transmits the reference signal to the multi-channel simulator 4. Control unit 10 applies control and adjustment of signal parameters at simulator 4, reflecting the operator inputs of assumed environmental and system conditions. The multi-channel simulator 4 processes the control unit instructions via hardware and software to simulate the multi-channel effects of delay, Doppler, and angular spread on the reference signal.

The test signals from the simulator 4 are directed into the smart antenna 6, where they are processed. The output of the smart antenna unit, in the form of digital data intended to replicate the multi-channel signals received at different sensors, is fed to the measuring device 8 of the linked signal source/measuring device. There the output is compared to the reference signal and control unit input parameters to verify the performance of the smart antenna 6. Control unit 10 permits a multitude of operator adjustments to account for different conditions by direct adjustment of signal parameters to common or specific channels, or through automated processing of selected environmental conditions into adjustments of signal parameters at common or specific channels.

The advantages of using a single unit as both signal source and measurement unit include reduced cost, reduced complexity of hardware, and direct connection between the signal source and the measurement unit. The signal source 2 can be a digital signal at the proper band, eliminating the need for an analog-to-digital conversion and downconversion in the multi-channel simulator. The measurement device already knows the input signal, and therefore only requires the control unit data involving the fixed antenna parameters and the programmed environmental and physical system factors. In addition, other functions of the simulator 4 can be accomplished by using a linked signal source/measuring device, further reducing simulator 4 complexity, test time, and cost.

Figure 3:
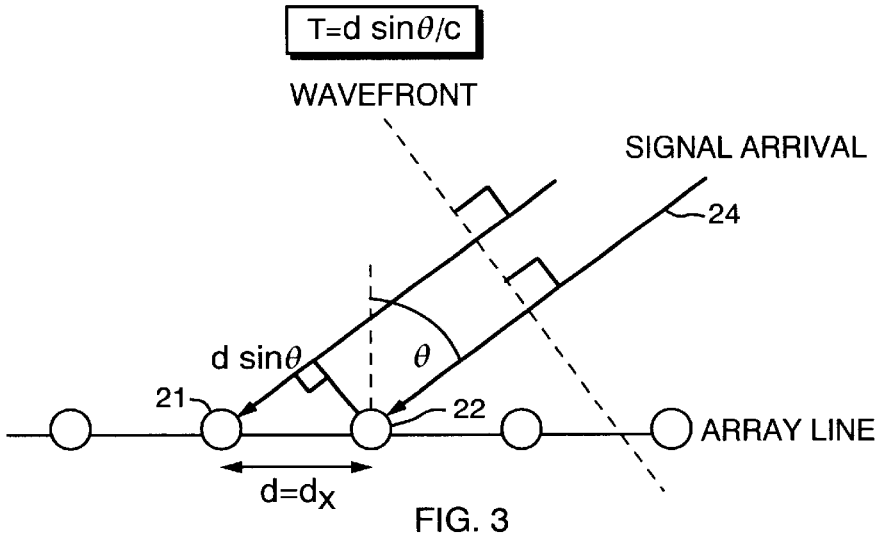
FIG. 3 is a top view depiction of a linear antenna array with incident signals shown striking two elements of the antenna array.

FIG. 3 shows the interstitial relationship amongst the individual sensor elements 21, and 22 of the antenna array. In a linear array, the distance (d) between the individual elements is constant, $d_x$. A signal 24 that is incident on the array at an angle θ hits each sensor at a slightly different time because of the extra distance represented by (d sin θ). Accordingly, the propagation delay between the sensor elements can be expressed as $T=(d \sin \theta)/c$. This delay is negligible because the denominator, c—the speed of light, is such a great number as compared to the numerator. It is assumed that the propagation delay across the antenna array is negligible for the preferred embodiment of the test system and simulator.

Figure 4:
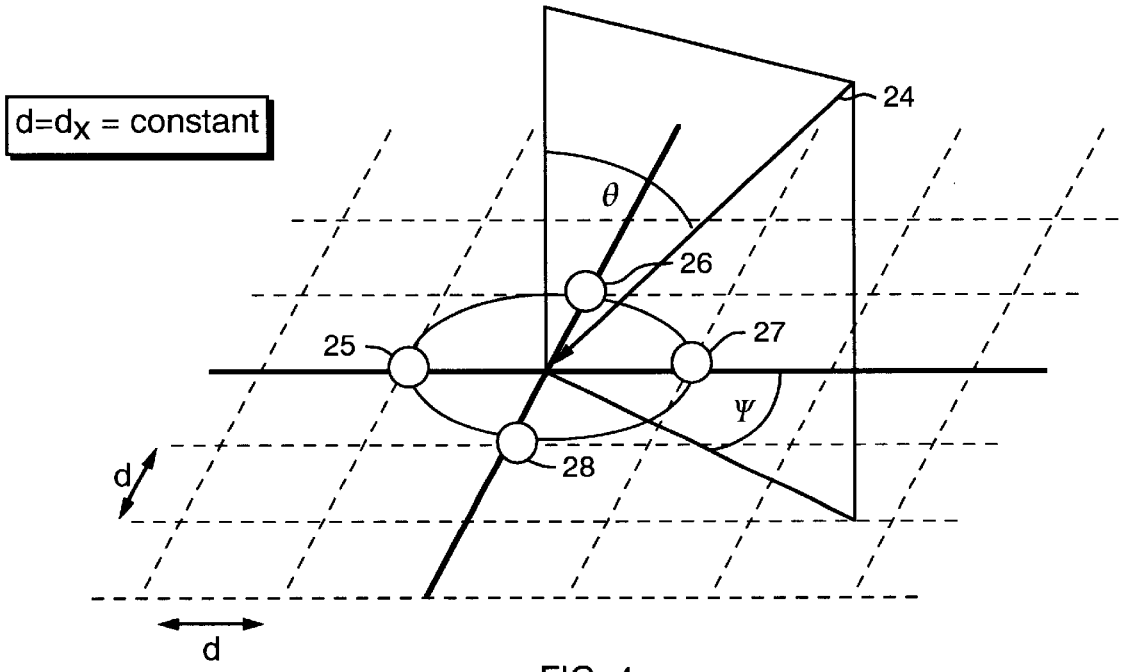
FIG. 4 is a three dimensional depiction of an incident signal upon an antenna array illustrating the interstitial relationship of four sensor elements in relation to the incident signal.

FIG. 4 depicts the incident signal 24 upon a planar antenna array with the adjacent sensor elements 25, 26, 27 and 28. The azimuth and elevation components of the incident signal are illustrated by Ψ and θ respectively. The signals that are incident upon sensors 25, 26, 27, and 28, are mathematically represented by advancing or retarding propagation delay T. The propagation delay of the simulated signal at each of the sensor elements is calculated by:

$$T_{25}=d/c\ (\sin\theta\ \sin\Psi)$$

$$T_{26}=d/c\ (\sin\theta\ \cos\Psi)$$

$$T_{27}=-d/c\ (\sin\theta\ \sin\Psi)$$

$$T_{28}=-d/c\ (\sin\theta\ \cos\Psi)$$

Thus, it is possible to calculate the propagation delay of any sensor location as long as the interstitial spacing, d, between the elements is known, and the angle of arrival is designated.

Figure 5:
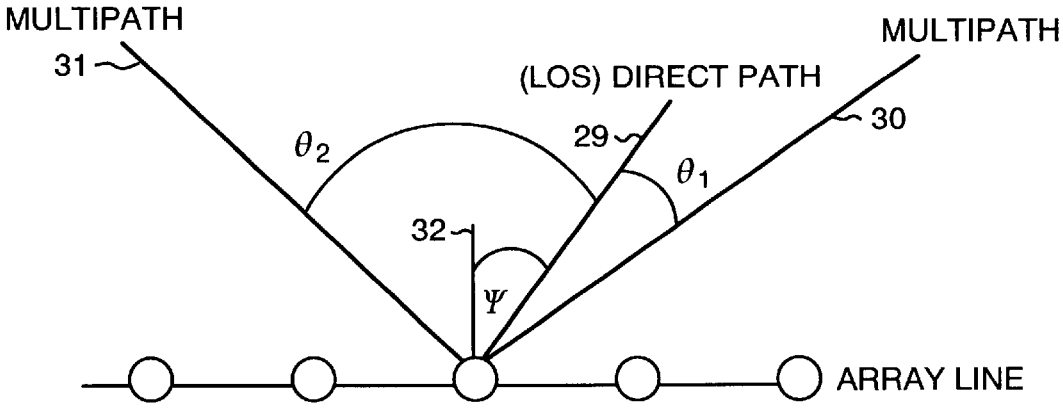
FIG. 5 is a top view depiction illustrating direct path and multipath signals incident upon a single antenna element of an antenna array.

The relationship of the multipath signals is illustrated in FIG. 5. At a given antenna element, the sensor receives signal data from the direct line-of-sight signal (LOS) 29, multipath 30, and multipath 31. The direct line-of-sight angle of arrival (AOA) is measured by the angular displacement from a fixed reference point, relative the axis vertical to the array plane 32, and is shown as Ψ. The multipath angular spread (AS) is measured by their relative displacement from the direct path signal 29, shown as $\theta_1$ and $\theta_2$. Thus, the multipath AOA=multipath AS−LOS AOA: Multipath 30 AOA=$\theta_1-\Psi$, and Multipath 31 AOA=$\theta_2+\Psi$. But, although the AOA and AS differ by a constant, the effect of adding a fixed constant does not directly translate the respective signals. The angular spread information references the line-of-sight signal from the user and is used to process the location of the mobile. In generating the test signals, the simulator processes the multipath signals for any number of multipaths and for any angular displacement depending on the desired testing. Urban environments would involve a much higher number of multipaths than rural areas, and the simulator would generate a corresponding greater number of multipaths.

Figure 6:
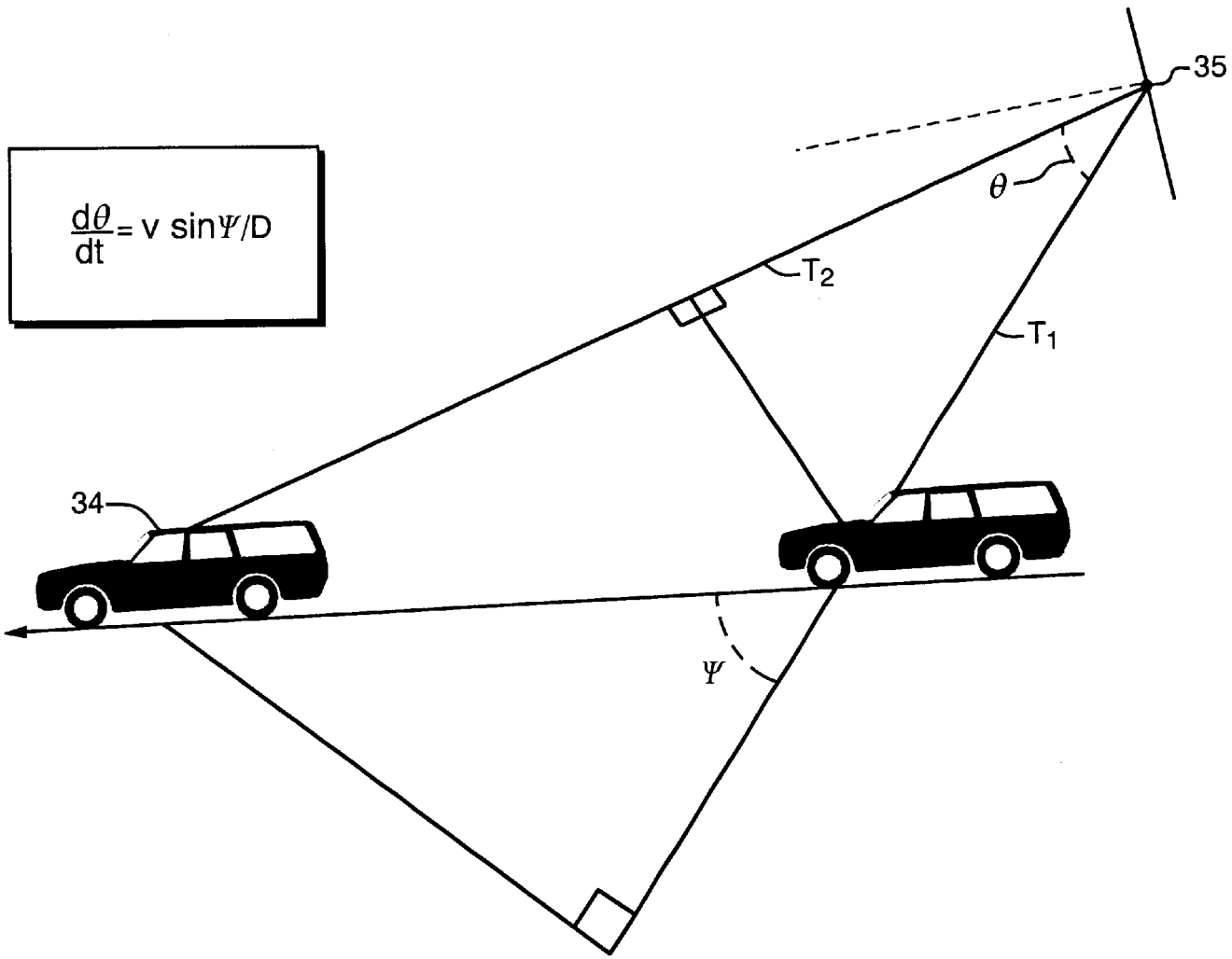
FIG. 6 shows consecutive transmissions between a moving vehicle and a base station and the angular effects thereof.

FIG. 6 helps to show the relationship of the Doppler effect, as caused by a moving mobile 34. The movement of the mobile unit with respect to the fixed base station antenna 35 causes a different angle of arrival for transmissions T1 and T2, T1 being the earlier transmission received at the base station antenna 35. The change in the angle of arrival, θ, is directly proportional to the velocity of the mobile and the distance traveled. The direction of the mobile is relevant because the compressed waves are experienced as the mobile travels towards the antenna, while the stretched waves occur as the mobile travels away from the antenna. The test operator and the test system vary the direction and speed of the mobile to account for the various Doppler spreads.

Figure 7:
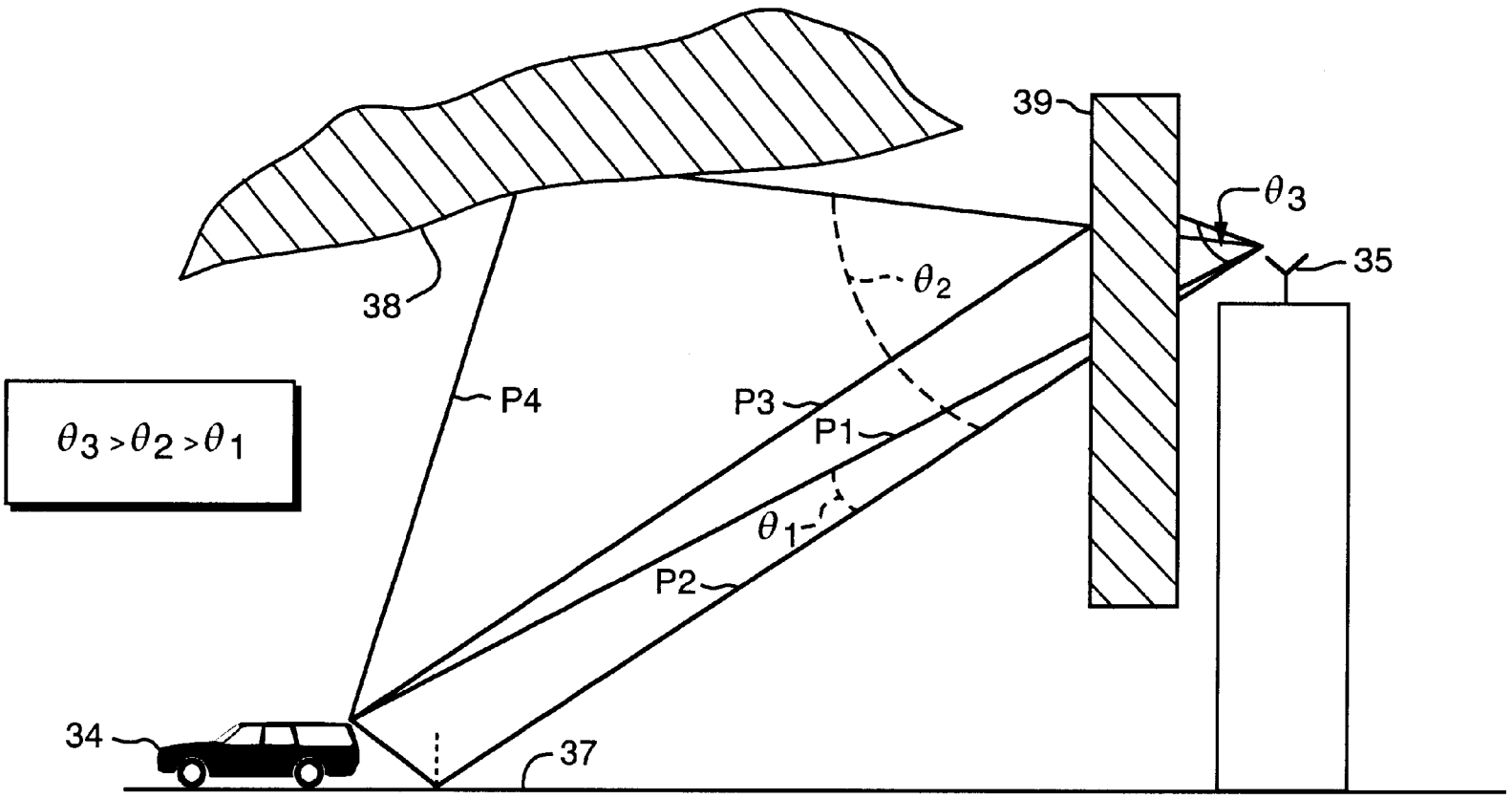
FIG. 7 is a two-dimensional side view illustration of a base station on a building, a mobile antenna unit, sources of reflection, and the local scattering effect.

FIG. 7 illustrates the occurrence of scattering and reflection that may effect the performance of a communications signal. Path P1 is the direct path from mobile 34 to base station antenna 35. The effects of reflection and scattering introduce multipath signals with different path lengths and angles of arrival, and therefore are significant factors in the simulator processing. The relationship between the angular spread and the delay spread are illustrated.

The scattering near mobile 34 caused by reflector 37 produces a very small angular displacement of path P2 at the base station antenna 35, as shown by $\theta_1$. A remote reflection caused by reflector 38 that arrives on path P4 at the base station antenna 35 may have a very large angular displacement, as shown by $\theta_2$. Finally, the local scattering effects at or near base station antenna 35, caused by deflections at region 39 on path P3, are highly unpredictable, and tend to introduce the greatest source of error in received signals.

The simulator uses sophisticated processing to account for the scattering effects. The simulator tags each generated signal with the corresponding angular spread or angle of arrival. The angular spread is the preferred tagging scheme in the preferred embodiment of the invention because it facilitates geo-location capability. The amount of scattering and the multipath reflection are dictated by the desired effect to be simulated.

Figure 8:
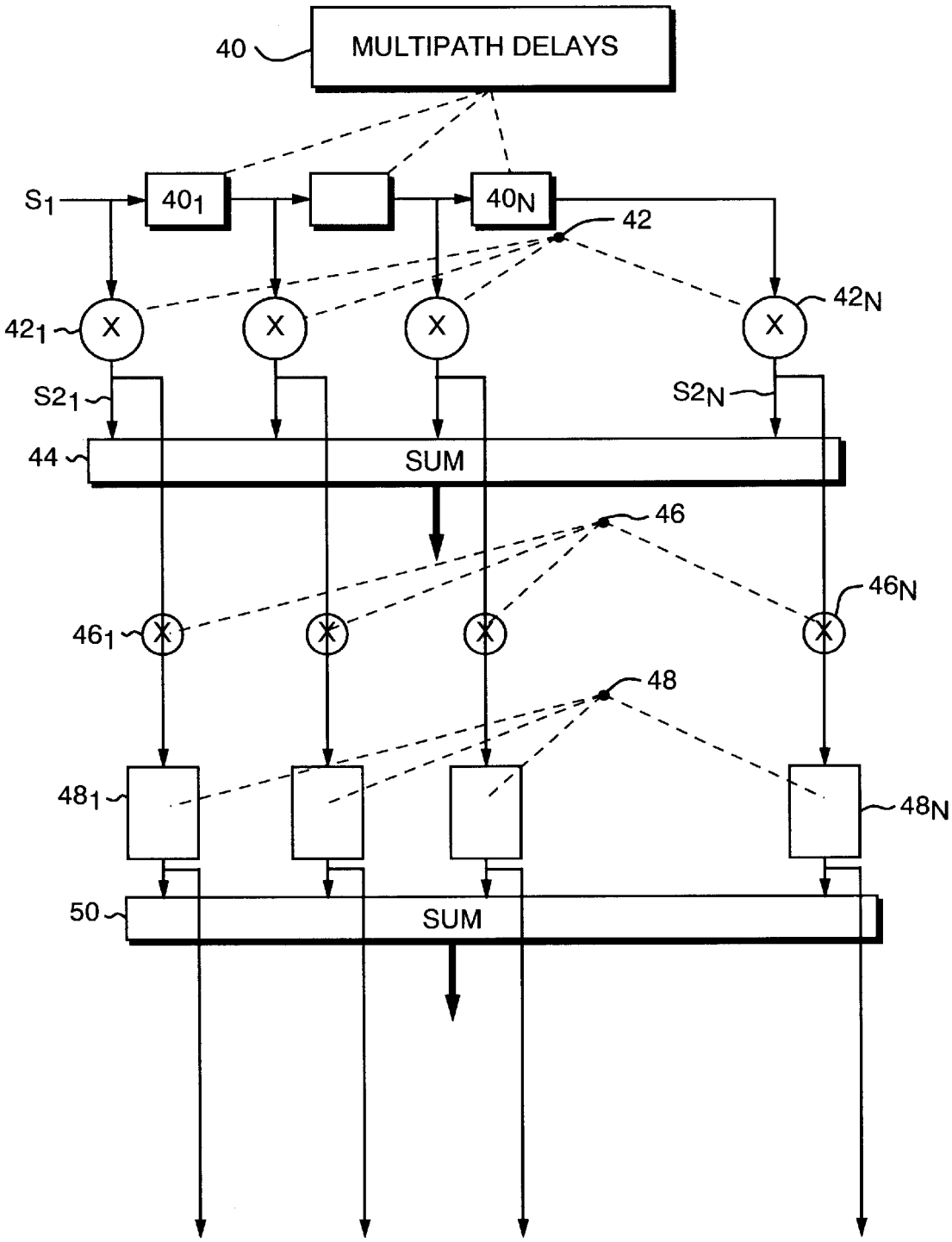
FIG. 8 is a block diagram of a smart antenna channel simulator, depicting an input signal modified by delay spread, Doppler spread, angular spread, and local scattering effect at each consecutive antenna element.

In FIG. 8, the basic block diagram of the smart antenna system multi-channel simulator is revealed. An input signal is generated either by the transmitter section or a separate piece of equipment. The signal is tagged with the angular spread or angle of arrival and fed as signal S1 into the simulator section of the smart antenna tester, where the various adjustable elements of the simulator are introduced. The multipath delay signal parameter adjustments $\mathbf{40}_{(1-N)}$ are inserted by using tap delay lines, to provide any number N of multipath delay signals to the first sensor 44. The delay spread is inserted to distinguish the various multipaths, and there can be any number of multipaths a s controlled by the operator.

The Gaussian fading signal parameter adjustment 42 is characterized by the Doppler spread representing the deterministic components directly related to the distance, the random components related to the terrain and the fast fading components related to the moving user and/or moving objects in-between that refract and reflect signals. The order $\mathbf{S2}_{(1-N)}$ at the first sensor 44 is represented by the sum of the input signal S1 attenuated by the appropriate fading parameter $\mathbf{42}_1$, plus the sum of each multipath signal $\mathbf{40}_{(1-N)}$ attenuated by its respective appropriate fain envelope $\mathbf{42}_{(2-N)}$. At the second sensor 50, the transformed data signals applied to the first sensor 44 are further manipulated to account for the practical reception environment. The first set of sensor signals $\mathbf{S2}_{(1-N)}$ is used as reference signals for the second sensor in order to establish a correlation between the sensor data sets. It would be difficult to extract the information after the signals are summed, so the first sensor signals are tapped to the second sensor after they have been transformed, but before the summation. The path loss across the array, from sensor to sensor, is negligible, and it is not necessary to introduce a second Doppler spread and Gaussian fading signal parameter adjustment 42, for subsequent sensors.

Propagation delay signal parameter adjustment 48 signals introduced into the second sensor 50 data to reflect the different angle of arrival of the signals due to the spacing of the sensor elements. Propagation delay is directly proportional to the angle of arrival, so each signal has a different delay 48(1-N). The multipath delays were previously accounted for at the first sensor 44 level by the tapped delay line 40, and no additional multipath delay is required across the antenna array. The Gaussian fading at each element is the same because the time to travel across the array is minimal in relation to the channel coherence time, and the terrain does not vary across the array.

In addition to the propagation delay adjustments 48, at the second sensor 50, the local scattering signal parameter adjustments 46 are considered, and the fading adjustments $46_{(1-N)}$ of the individual sensor lines is applied. Scattering de-correlates, or at least reduces the correlation of the received signals across the array. The more scattering, the more de-correlation. Each scattering has a different and random phase characteristic. Many smart antenna systems cannot completely handle de-correlation because they depend on combining the data from the different antennas in the array based on the assumption that the impinging signals carry clear bearing characteristics. Therefore the simulator accounts for antenna height and the local scattering effect to account for amount of correlation. The mathematical models are used to develop and produce the proper scattering effect.

The amount of correlation between the signals received by two antenna elements due to the same source depends on two important factors, the antenna interelement spacing and the scattering environment. To fully test smart antenna systems under various communication channels, the test simulation induces any correlation factors for the signal arrivals across the array. This correlation incorporates the decorrelation effects of local scattering, which presents a multipath environment that allows the faded signal to be fully or partially correlated or completely uncorrelated at the different antenna elements. The signal processing of the simulator allows the test system to generate the signals according to any specified spatial correlation function or model.

Let $r_{ij}$ denote the correlation factor between the complex envelope of the signal received by array antenna elements i and j. For N element array, there are N×N correlation factors. Since the correlation between sensor i and j is the same as the correlation between sensor j and i, the number of correlation factors to can be defined independently is reduced to N(N+1)/2.

Let R define the correlation matrix, which includes the correlation factors defined above.

$$R = \begin{bmatrix} r_{11} & r_{12} & \cdots & r_{1N} \\ r_{21} & r_{22} & \cdots & r_{2N} \\ \cdots & \cdots & \cdots & \cdots \\ r_{N1} & r_{N2} & \cdots & r_{NN} \end{bmatrix}$$

By spectral decomposition, matrix R can be written as $$R=B^{1/2}B^{1/2H}$$

where H denotes hermition, which is the complex conjugate transpose operation. The method of generating the signal with different correlation coefficients is summarized as follows:

1. Generate N samples of Gaussian random independent samples x(1), x(2), . . . x(N).
2. Generate a new set of samples y(1), y(2), y(3), , y(N) such that $$y(n) = \sum_{k=1}^{N} b_{nk} x(k),\ n = 1, 2, 3, \ldots, N$$

where $b_{nk}$ is the (n,k)-th element of matrix B. The data samples y(n), n=1,2, . . . N have the correlation values which match those specified by the correlation matrix R- The process is repeated and for every N input data samples of x, we generate N output data samples of y.

3. The sequence y(1), y(N+1), y(1N+1), . . . , y(NL+1), . . . is taken to represent the complex envelope of the signal received by the first antenna element, which has been originally defined as $\gamma_{1i}(t)$. In the same manner, the sequence y(2), y(N+2), y(2N+2), . . . , y(NL+2), . . . is taken to present the complex envelope of the signal received at the second antenna element. The sequence y(k), y(N+k), y(2N+k), . . . , y(NL+k) is taken to represent the complex envelop of the signal received at the k-th sensor, and so forth and so on.
4. The sequences x(k), x(N+k), . . . , x(NL+k), . . . , k=−1,2,3, . . . ,N are chosen to satisfy specific Doppler spread and frequency dispersion property of the communication channel. For specified Doppler shift and spectral shape, Clarke's model can be implemented to induce the proper fading envelopes. One variation of the above algorithm is to change the sequence of operations. That is, instead of correlating the signals then fading them as discussed above, the signals are first faded, and then the proper correlation coefficients are generated between the different pairs. It should be noted that the mathematical equations remain the same, independent of the cascading order of the fading-correlation operations. The process is repeated for N new samples to generate N new samples of y.

Although the preferred embodiment uses the first set of sensor signals prior to summation in order to establish correlation for the next sensor, it is within the scope of the invention to process the summed data and reconstruct some correlated portion of the initial signal It is also within the scope of the invention to use independent signals with little or no correlation. Although there would be a loss of correlation, it is still possible to check the integrity of the smart antenna processing without correlated signals, but with decreased reliability. The signal processing continues for each sensor, until all sensor signals have been generated.

Although the preferred embodiment assumes that the multipath delay across the array is negligible, it is within the scope of this invention to introduce the multipath delay at each antenna element. The addition of multipath delay components between each number of multipaths can be accomplished by adding additional delay as illustrated for the first sensor or calculating the effective delay and introducing this delay into the subsequent processing at the later sensor elements.

Figure 9A:
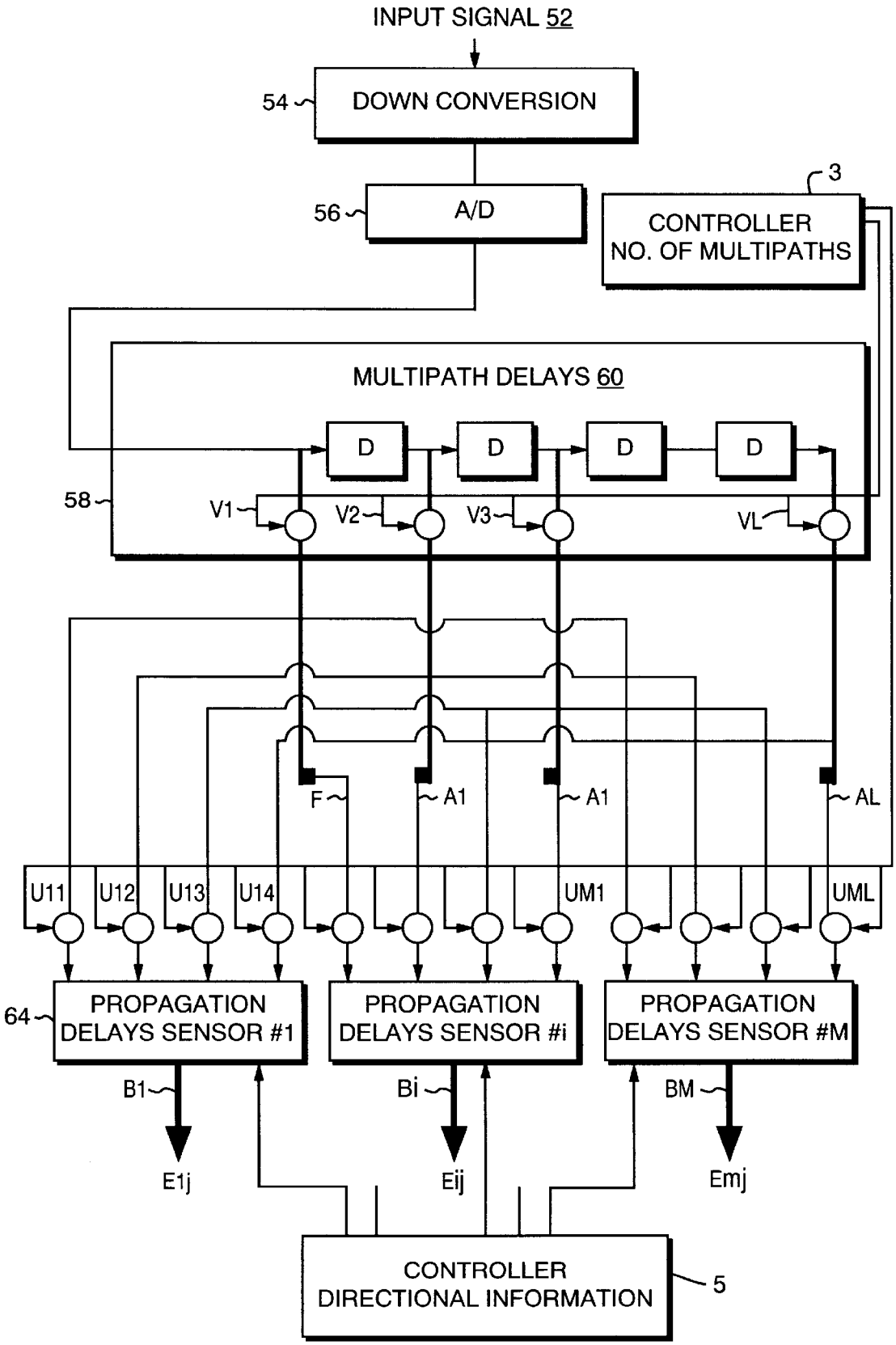
FIGS. 9A and 9B are a detailed block diagram of a smart antenna channel simulator, depicting a downconverted input signal converted to a digital signal, hence transformed by delay spread, Doppler spread, angular spread, and local scattering effect at each consecutive antenna element, the resultant signals converted back to analog form and upconverted to the proper band.
Figure 9B:
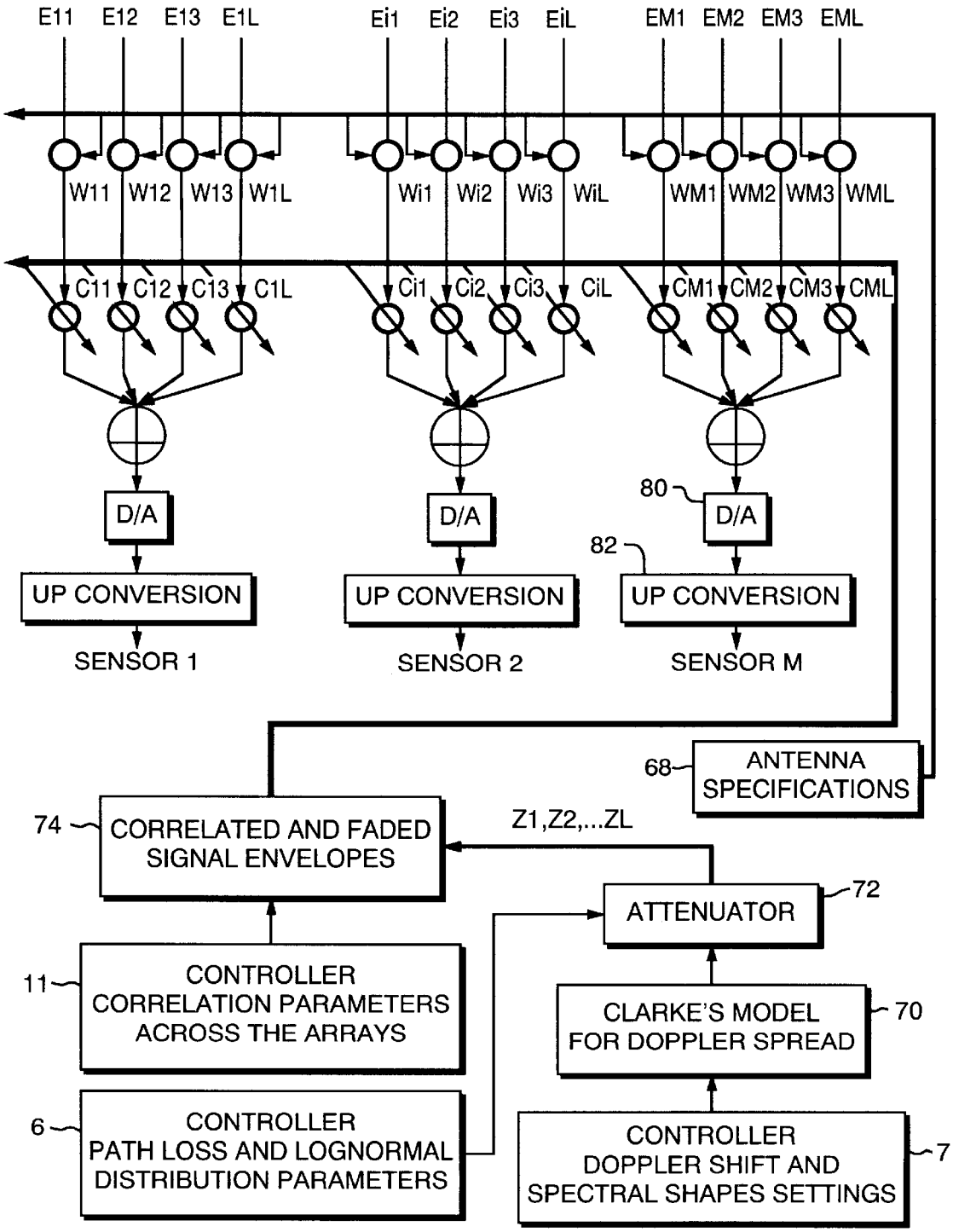

In FIGS. 9A and 9B, a more elaborate block diagram of a multi-channel simulator is provided. The down converter 54 shifts the input signal 52 to its baseband. The baseband signal is digitized through the analog/digital (A/D) converter 56. The number of multipaths L and the delay spread adjustment is set by a computer interface designated as Controller 3.

The downconversion 54 and A/D conversion 56 would not be required if the input signal were generated as a digital signal source at the proper baseband. An example of such a source would be a bit-error-rate tester (BERT), which inks a digital signal source with a digital measuring device. Using a linked digital source/measuring device would reduce the hardware and software complexity of the simulator and controller functions, and reduce test time.

The process of generating the proper multipath delays consistent with the parameters set in Controller 3 is achieved by using a digital signal processing means, such as a digital signal processor ()SP), implementing the tap delay line 60 in the multipath delay block 58. The delay element D and the number of multi-path signals are set by Controller 3 according to both the defined operating environment (Urban, Rural, Light Industry, etc.) and the signaling schemes (TDMA, GSM, CDMA, etc.). The multipath delays are changed by setting the multiplication coefficients V(I–L) to unit or zero values. For example, if coefficient $V_2$ is zero, the first multipath arrives after 2D time, as the $V_2$ signal along that path is eliminated.

The multipath signal arrivals are then split into additional channels for different sensors where they encounter propagation delays B(1–M), depending on the sensors they are reaching. However, prior to inducing the proper delays to reflect the time taken to travel across the array, the direct path F and multipath signals $A_1, A_2, A_3, \ldots A_L$ exiting the multipath delay block 58 are multiplied by the coefficients $U_{ij}$, i=1,2, . . . M, j=1,2, . . . L. These coefficients take binary values 1 or 0 and are selected by Controller 3. Their functionality is to allow the exact number of channels (sensors) set by Controller 3 into the simulation. For example, if all $U_{ij}$=0 for i=2,3, . . . ,M, then only one sensor is considered (sensor #1), representing a single antenna case.

The propagation delays 64 are performed by the DSP chips $B_1$ to $B_M$, where M is the number of sensors. The input to each chip is the L direct and multi-path signal arrivals and the output is the L propagation delayed signals designated for one specific sensor. A possible variability of this implementation is to combine the M DSP chips into one single DSP chip to perform all propagation delays needed for the simulation. The values of the propagation delays are set by Controller 5, which carries the angle of arrival or the angular spread information of each signal arrival. Controller 5 also stores the geometry of the array under consideration. The propagation delayed versions of all arrivals $E_{ij}$, j=1,2, . . . L reaching sensors i, i=1,2, . . . M are multiplied by the antenna gain and phase responses represented by the complex weights $W_{ij}$, i=1,2, . . . M and j=1,2, . . . L. These weights are set by the Antenna Specification 68, which includes antenna types (Omni, Sectorized, . . . ) and antenna pattern.

The outcomes of the multiplication operations are then faded. The slowly varying fading parameters are set by a computer interface designated as Controller 6. Controller 6 stores, for each arrival, the following information: 1) the path loss, and 2) the slowly fading (lognormal distribution) parameter. On the other hand, the Doppler shift and spectral shape for the rapidly varying fading parameter are set by Controller 7. The rapidly varying fading parameters are fed into Clarke's model 70, which generates the Rayleigh fading envelope for each multipath. It is noted that the line of sight assumption is provided by Controller 3 and, if preset will communicate with Controller 7 to allow for the generation of Rician fading envelope for only the undelayed signal $V_1$. This communication is assumed since both Controllers can be the same computer. A variation of Clarke's model, including Jakes model and other fading models for indoor communications is also within the scope of the invention.

The outputs of Clarke's model is fed to attenuator 72 to apply both the loss due to the distance traveled by each arrival and the shadowing effect represented by the lognormal distribution. The fading envelopes $Z_1, Z_2, \ldots, Z_L$ enter correlator 74, which splits each envelope into M correlated signals. This correlation is achieved by matrix manipulation of the faded signals, as described herein. It represents the effect due to local scattering on each arrival, as it travels across the array. The correlation parameters are stored in Controller 11. The number of outputs of the correlator is the product of the number of arrivals M and the number of sensors L. These outputs represent the multiplication coefficients $C_{ij}$, i=1, . . . L, j=1, . . . M of the delayed signals $E_{ij}$, i=1, . . . L, j=1, . . . M. The results of this multiplication are summed to provide the delayed faded correlated signals for the different sensors.

These signals are then converted back to their corresponding analog forms by D/A converters 80 and up converted to their original bands by the upconverters 82. The resultant multi-channel sensor signals are transmitted to the smart antenna system for processing.

The simulator is not limited to any specific number of DSP units, nor is the sequential processing steps of significance. It is within the scope of the invention that a single processor performs simultaneous computation of the desired multi-channel signals.

The parameters in Controllers 3 and 7 can be set to generate the following special cases:

1) All correlation coefficients are set to a unit value, indicating full correlation of each arrival across the array. This is the case where the local scattering effect is ignored and/or when the sensors are spaced very closely to each other.
2) The correlation coefficients are set to very small values, indicating small partial correlation of each arrival across the array. This is the situation in which local scattering is pronounced or when the sensors are widely spaced.
3) The coefficient $V_1$ is set to a unit value, indicating the presence of direct path.
4) The coefficient $V_1$ is set to zero, indicating the abstraction of the direct path.
5) The coefficients $V_2$ to $V_L$ are set to zeros, indicating a flat fading scenario.
6) All Doppler shifts are set equal to the same value, indicating similar fading to all arrivals.
7) All binary coefficients Uij are set to zeros except U11,U12, . . . ,U11, indicating a single antenna base station.
8) All weights $W_{ij}$, I=1,2, . . . M, j=1,2, . . . L are set to a unit value, indicating omni-directional antennas.

The multi-channel simulator described in FIGS. 9A and 9B are capable of generating a number of spatial propagation models suitable for indoor, outdoor, wireless local area networks, and wireless local loop environments. This is achieved by proper selection of the values of the parameters shown in the block diagram of FIGS. 9A and 9B, and described herein. Further, the communication channels for both long-range and short-range wireless connectivity between several transmitters and receivers are easily incorporated in the block diagram and generated by the multi-channel simulator.

Some commonly assumed spatial propagation models include:

1. Lee's Model: effective scatterers are evenly spaced on a circular ring about the mobile. The model predicts the correlation coefficient using a discrete angle-of-arrival model and can be extended to account for Doppler shifts.
2. Discrete Uniform Distribution: scatterers are evenly spaced over an angle-of-arrival range. The model predicts the correlation coefficient using discrete angle-of-arrival models. The correlation predicted by this model falls off more quickly than the correlation in Lee's Model.
3. Geometrically Based Circular Model: this model assumes that the scatterers lie within a circular ring about the mobile. Joint angle-of-arrival and time-of-arrival as well as Doppler shift and signal amplitude information are provided. This model is intended for macrocell environments where antenna heights are relatively large.

4. Gaussian Wide Sense Stationary Uncorrelated Scattering Model: scatterers are grouped in clusters in space, such that the delay differences within each cluster are not resolvable within transmission signal bandwidth. This model represents an analytical model for the array covariance matrix.
5. Gaussian Angle-of-Arrival: this is a narrow band channel model, and is a special case of the Gaussian Wide Sense Stationary Uncorrelated Scattering Model. This model deals with a single cluster and the angle-of-arrival statistics are assumed to be Gaussian distributed about some nominal angle.
6. Time-Varying Vector Channel Model: this model assumes that the signal energy leaving the region of the mobile is Rayleigh faded. The angular spread is accounted for by dominant reflectors. The model provides both Rayleigh fading and theoretical spatial correlation properties.
7. Uniform Sectored Distribution: it is assumed that the scatterers are uniformly distributed within an angle distribution and a radial range centered around the mobile. The magnitude and phase associated with each scatterer is selected at random from the uniform distributions [0.1] and [0, 360] respectively.
8. Modified Saleh Valenzuela's Model: this model is suited for wideband communication environment. It is an extension of the traditional statistical tap-delay line model, which includes angle-of-arrival information.
9. Spatio-Temporal Model: this model provides multipath propagation based on the distribution of scatterers in elliptical sub-regions, corresponding to a range of excess delay time.
10. Ray Tracing Model: this model is based on the geometric theory and reflection, diffraction, and scattering models. It uses the users site-specific information, such as building databases or architecture drawings.

The present invention is capable of deriving a Doppler spread effect of the signals using any of the various models for both indoor and outdoor communication models. Distinguishing aspects of the indoor and outdoor fading spectrums are that indoor fading spectrums tend to characterized as flat spectrum, while the outdoor fading spectrum is characterized a classic or Rayleigh spectrum. For any Doppler spread, there are number of Doppler spectrums. If one considers the Doppler spread a length of a signal, the spectrum refers to the shape of the various components of the signal.

Figure 10A:
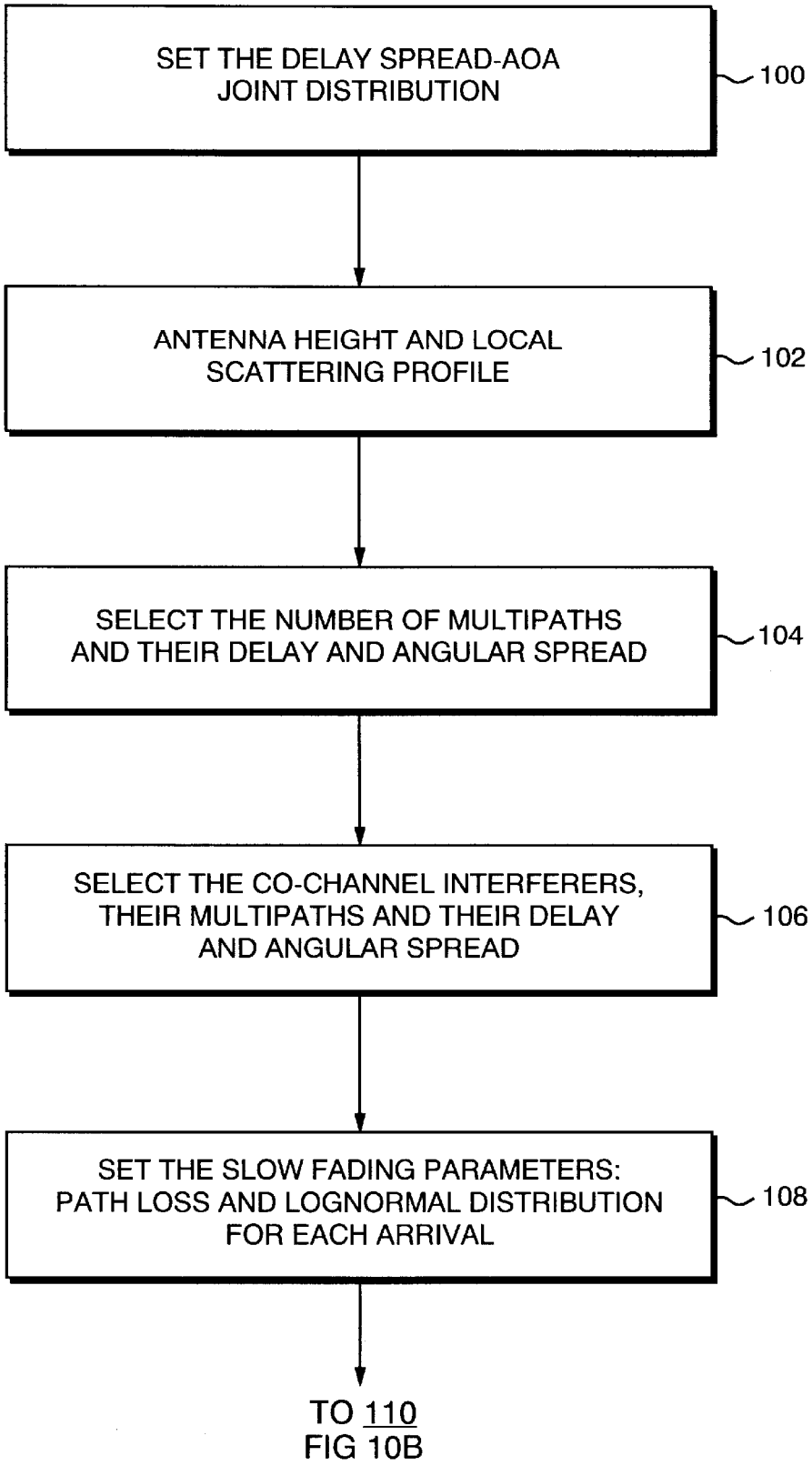
FIGS. 10A and 10B are a singular flowchart of the operations in a Smart Antenna testing equipment.
Figure 10B:
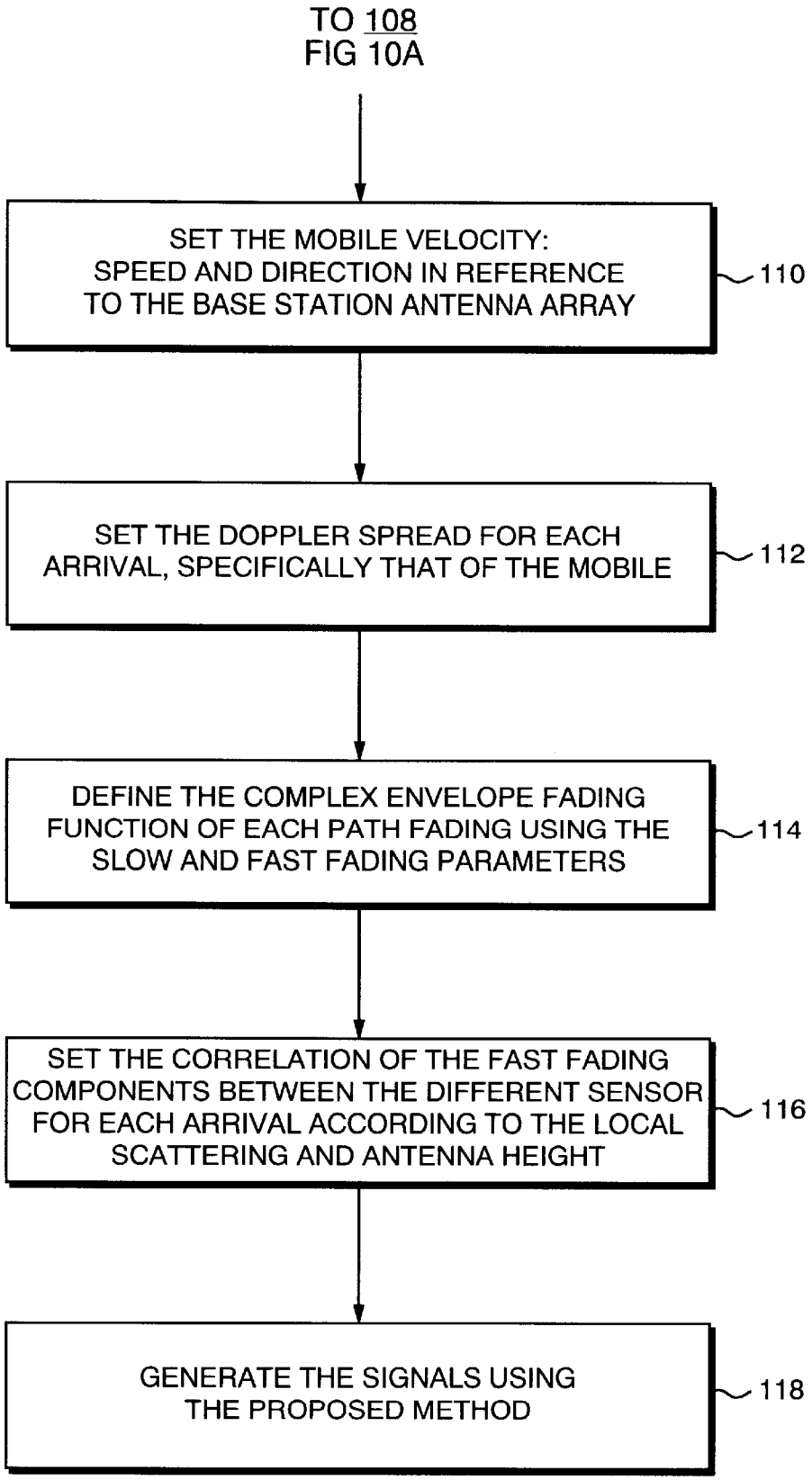

FIGS. 10A and 10B illustrate a block diagram representation of the various operations of the test system/simulator applied to a reference signal in order to generate a full multi-channel signal simulation representative of an actual communications signal received by a smart antenna. The various signal parameter adjustments may be manually entered and/or variably adjusted by the test equipment controller. The values can be varied or pre-set according to certain conditions representing environmental conditions such as urban, suburban, and rural; and for different smart antenna configurations.

While the exact sequence of execution is not critical, initial block 100 represents tagging of signals with the angle of arrival and setting of the multipath delay spread.

The next block 102 represents incorporating the subject smart antenna characteristics. The test system requires profile data of the antenna height and local scattering profile, along with any calibration data about the antenna array. The antenna manufacturers have calibration data associated with the antenna, and information about the interstitial placement of the sensor elements, the frequency -vs- gain characteristics, the angle-of-incidence -vs- gain characteristics, and the installation height of the antenna have to be entered, either by database tables, or manual entry.

In the next block 104, the operator selects the number of multipaths with their corresponding parameters of delay and angular spread.

The number of co-channel interferers and number of multipaths of co-channel interferers is selected in the next block 106, along with their associated propagation delay and angular spread.

The next block 108 is to set the slow fading characteristics for the system. One component is the path loss of the individual signals based on the simulated or estimated distance traveled by the signals. Another component is the shadowing effect, represented as a log-normal distribution.

The next block 110 sets the speed and direction of the mobile unit in relation to the base station array.

The Doppler spread is set in the next block 112 for each channel. The Doppler spread is represented as a complex Gaussian fading process in the preferred embodiment, although other models may be used.

Next 114, the complex envelope of the fading function for each path is computed for the slow and fast fading parameters. The fast fading portion may be represented by several mathematical models that are used as part of the processing.

Then 116, software algorithms compute the correlation between the antenna geometry and the selected conditions.

In the last block 118, the simulated signals are generated and directed to the smart antenna receiver path.

Figure 11:
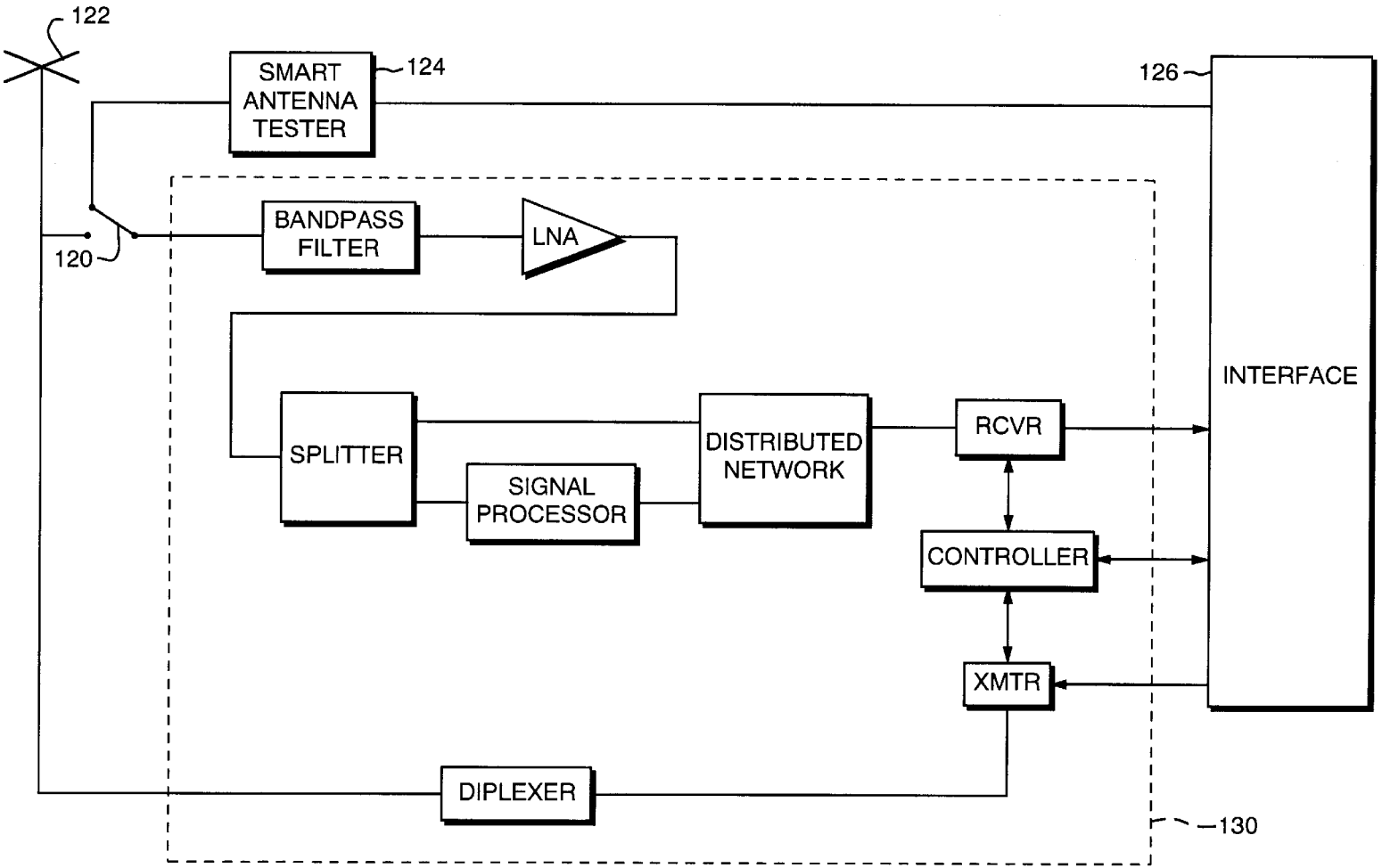
FIG. 11 is a block diagram of a smart antenna tester connected to a smart antenna system.

FIG. 11 is a block diagram representation of the smart antenna processor system 130 in the field, with the smart antenna test equipment 124, incorporating all the elements of the tester of FIG. 1, connected into the receiver path of the smart antenna. A switch 120 is used to disconnect antenna array 122 from the smart antenna processor system 130. When testing is implemented, the switch 120 connects the smart antenna test system 124 to the smart antenna 130. The simulator of test system 124 generates the multi-channel test signal models desired to perform functionality testing of the smart antenna 130. Various conditions are simulated, and the results of the processing are transmitted from the interface 126 to the test system 124 for analysis.

The output of the smart antenna 130 is a digital stream of data and can be connected to an interface 126 that connects to the smart antenna tester 124. The smart antenna tester incorporates a measuring device that analyzes the smart antenna output as compared to the test signal.

The preferred embodiment requires a continuous monitoring of the smart antenna results in order to automate the testing and verify the results in an expedited manner. Manual testing of the system requires the operator to verify the results of each test at the interface.

The switching mechanism is only one method of introducing the test system into the receiver chain; other coupling or switching means can be employed within the scope of the invention. Alternatively, the cable from the antenna can be disconnected and, using the appropriate adapter, the test system or simulator can be connected directly to the smart antenna processor input line.

The connecting means described here is for connecting the test system 124 or simulator to an existing smart antenna assembly, but the test system and simulator can also be employed in factory or laboratory environments, allowing easier access to the input/output. The production line testing of the smart antenna processor is easily performed as long as the antenna profile is characterized, and the environmental conditions and antenna height are known. The preferred embodiment of the invention uses all possible data about the environment, antenna, terrain, and conditions to create a realistic testing scenario. The testing can be accomplished without certain data, but the reliability and thoroughness of the testing decreases.

Figure 12:
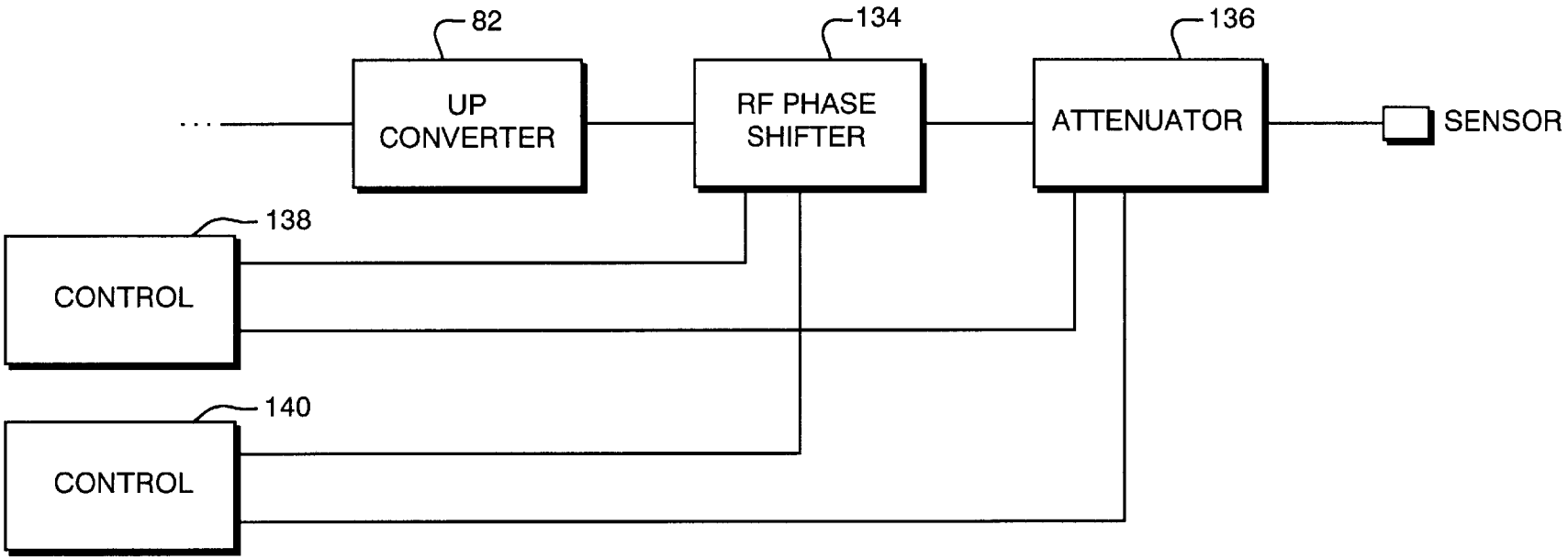
FIG. 12 is a block diagram of a smart antenna channel simulator illustrating additional control mechanisms of an RF phase shifter and an attenuator.

A variation of the channel simulator is disclosed in FIG. 12, allowing additional adjustment mechanisms. In this embodiment, the processed signals from the upconverter 82 of FIG. 9B are connected in series with an RF phase shifter 134 and an attenuator 136. These elements can be automatically controlled by the control unit, or manually controlled by the test operator. The RF phase shifter 134 allows for the simulated outputs to be varied in phase, either manually or by an external control 138. The attenuator 136 can be used to step-down or decrease the simulated signal levels according to control 140. The control units 138, and/or 140 can be connected to the other controllers of the simulator 4 to coordinate the signal channel adjustments.

It is within the scope of the invention to employ feedback loops of the output signals to a DSP or computer interface with information about the output signal. Although not a necessary feature, the feedback mechanism allows the simulator to correct the internal processing to account for any discrepancies between the expected signals and the resultant signals. The feedback allows for correction or adjustment of the signals due to losses or interference in the simulator.

Referring to FIG. 12 and to FIG. 9B, the feedback loop is run from a point near the output, at the up conversion stage 82 or the D/A stage 80. The loop transmits the output signal and the expected output signal to a measuring unit that compares the two signals. The measuring unit can be a simple comparator circuit or similar device. Any discrepancy between the signals is detected and a corrective signal is calculated that changes some parameter within the simulator 4, such as the attenuator 72. The resulting output signals are of a higher precision. The RF phase shifter 134 and attenuator 136 can be used in conjunction with the feedback loop to facilitate the correction.

The invention is susceptible to many variations. For example, there may be a smart antenna test set for evaluating the performance of a smart antenna system, that has a source for a reference signal, a multi-channel signal simulator for generating output signals from the reference signal to several output channels which are connectable to the smart antenna system being tested. A control unit with an operator interface is used for operator inputs which may include information on the fixed characteristics of the smart antenna system and user selectable test conditions such as the environmental and equipment conditions desired for simulation The test set would include a means for transforming the operator inputs into channel-specific delay, Doppler, and angular spread effects, and means for modifying said output signals with these effects, such as having the control unit connected to the simulator, and the combination of them having sufficient software and circuitry to interpret the operator inputs as channel-specific, electronic modifications to the output signals. There would also be a measurement device that can be connected to the output of the smart antenna system for receiving and measuring the smart antenna system response.

The smart antenna test set may have the control unit connected to the measurement device so that the smart antenna system response can be compared to the reference signal and the operator inputs. Also, there by be independent means for adjusting the delay, Doppler, and angular spread effects in each of the output channels.

As a further example, there may be a smart antenna test set for evaluating performance of a smart antenna system that uses a signal source and a measuring device where the two units are linked such that the measuring device perceives the input reference signal and compares the smart antenna output to the input. An example of a linked source and measurement device is a bit-error-rate tester (BERT) that generates a digital reference signal. The linked source input is connected to a multi-channel signal simulator for generating output signals from the reference signal to several output channels, where the output channels are connectable to the smart antenna system being tested. The test set would have a control unit with an operator interface where the operator inputs information on the fixed characteristics of the smart antenna system and user selectable test conditions, such as environmental and equipment conditions.

There would be hardware and software in the simulator for transforming the operator inputs into channel-specific delay, Doppler, and angular spread effects for modifying the signals transmitted to the smart antenna The measuring device would be connected to the control unit, either alone or in conjunction with the linked reference source input, and connectable to the smart antenna system. The measuring device would receive and compare the smart antenna system response output to the reference signals and the operator inputs.

As a yet further example, there may be a smart antenna channel simulator with an input signal port, a splitter assembly, and several signal paths connected to the splitter assembly; where each signal path terminates at an output signal port, and the output signal ports are connectable to the smart antenna system being tested. The simulator would have a control unit with an operator interface where the operator inputs information about the fixed characteristics of the smart antenna system and the desired test conditions, including environmental and equipment conditions. The simulator would have a way to transform the operator inputs into channel-specific delay, Doppler, and angular spread effects, and apply them to the respective said signal paths; such as with software and hardware in the control unit and installed in the signal paths.

The simulator may have a downconverter assembly connected to the input signal port and an analog-to-digital converter section connected to the downconverter. Each of the signal paths may have a digital signal processing unit connected to the splitter assembly, a digital-to-analog converter section connected to each of the digital signal processing units, an upconverter unit connected to each of the digital-to-analog converters, and an output signal port connected to each of the upconverters. The simulator may have feedback loops connecting the output signal ports back to the digital signal processing units.

The unit may also have independent means for adjusting the delay, Doppler, and angular spread effects in each signal path, such as an RF phase shifter, or an attenuator.

As a still yet further example, the invention may be practiced as a method for testing a smart antenna system, consisting of the steps of providing a source signal; generating several output signals from the source signal; generating control inputs representing test conditions; transforming the control inputs of test conditions into channel-specific delay, Doppler, and angular spread effects; modifying the output signals with these delay, Doppler, and angular spread effects to produce a net test signal such as a coordinated set of signals for distribution to respective individual sensor inputs of the smart antenna processor, or a single, composite signal containing the integrated combination of the output signals, for feeding to a central antenna input on the smart antenna processor; and measuring the smart antenna system response. The test conditions may include user selected environmental and equipment conditions for simulation The method may further include comparing the smart antenna system response to the source signal and the control inputs.

The step of generating a plurality of output signals may use a multi-channel signal simulator. The signal source may be a bit-error-rate tester. The step of modifying the output signals may include effects of local scattering.

The objects and advantages of the invention may be further realized and attained by means of the instrumentalities and combinations particularly pointed out in the appended claims. Accordingly, the drawing and description are to be regarded as illustrative in nature, and not as restrictive.

What is claimed is:

1. A smart antenna test set for evaluating performance of a smart antenna system, comprising:

a source for a reference signal;

a multi-channel signal stimulator for generating a plurality of test signals from said reference signal, said test signals connectable to said smart antenna system;

a control unit with an operator interface wherein operator inputs represent characteristics of said smart antenna system and user selectable test conditions;

means for transforming said operator inputs into delay, Doppler, and angular spread effects;

means for modifying said test signals with said delay, Doppler, and angular spread effects;

means for inserting said test signals into a smart antenna processor, and a measurement device connectable to an output signal response of said smart antenna processor, wherein said measurement device compares said output signal response to an expected response.

2. The smart antenna test set of claim 1, said means for transforming further comprising into local scattering effects, said means for modifying further comprising with local scattering effects.

3. A smart antenna test set according to claim 1, wherein said control unit is connected to said source, to said measurement device, and to said output signal response, and said expected response is a function of said reference signal and said operator inputs.

4. A smart antenna test set according to claim 1, wherein said means of transforming said operator inputs and said means for modifying said test signals comprise in combination:

said control unit connected to said simulator, said control unit and said simulator incorporating software and circuitry adapted to interpret and apply said operator inputs as modifications to said test signals.

5. A smart antenna test set according to claim 1, wherein said test conditions comprise assumed environmental and equipment conditions.

6. A smart antenna test set according to claim 1, further comprising means for adjusting each of said delay, Doppler, and angular spread effects of each said test signal.

7. A smart antenna test set according to claim 1 wherein said source and said measurement device are interconnected.

8. A smart antenna test set according to claim 1, wherein said measurement device comprises means for interpreting a geo-location response from said output signal response.

9. A method for testing a smart antenna system, consisting of the steps:

providing a reference signal;

generating control inputs representing test conditions;

transforming said control inputs into delay spread effects, Doppler spread effects, and angular spread effects;

generating a plurality of multipath signals as a function of said reference signal and said delay spread effects;

generating a plurality of channel signals as a function of said multipath signals, said Doppler spread effects, and said angular spread;

summing selective sets of said channel signals into sensor signals, each said sensor signal corresponding to a respective sensor of the sensor array of said smart antenna;

applying said sensor signals to the smart antenna processor of said smart antenna system, receiving a smart antenna system response;

measuring said smart antenna system response with a measurement device.

10. The method for testing a smart antenna system of claim 9, said transforming said control inputs further comprising into local scattering effects; said generating a plurality of channel signals as a function further comprising of said local scattering effects.

11. A method for testing a smart antenna system according to claim 9, said test conditions comprising user selectable assumed environmental and equipment conditions and geo-location of source of said reference signal for simulation.

12. A method for testing a smart antenna system according to claim 9, further comprising the step of comparing said smart antenna system response to said reference signal and said control inputs.

13. A method of testing a smart antenna system according to claim 12, said step of comparing said smart antenna system response further comprising comparing geo-location information in said smart antenna system response to said reference signal and said control inputs.

14. A method for testing a smart antenna system according to claim 9, wherein said generating a plurality of multipath signals comprises using a multi-channel signal simulator.

15. A method for testing a smart antenna system according to claim 9, said providing a reference signal comprising use of a bit-error-rate tester.

16. The method for testing a smart antenna system according to claim 9, said method conducted with apparatus comprising a control unit connected to a multi-channel simulator, said control unit and said simulator incorporating software and circuitry adapted to interpret said control inputs as modifications to said reference signal.

* * * * *